US012172790B1

(12) United States Patent
Obrien et al.

(10) Patent No.: US 12,172,790 B1
(45) Date of Patent: Dec. 24, 2024

(54) VISUAL INDICATORS FOR OPTIMIZED PACKING OF MULTI-ITEM PACKAGES

(71) Applicant: Amazon Technologies, Inc., Seattle, WA (US)

(72) Inventors: Thomas Russell Obrien, Woodinville, WA (US); Joshua Arleigh Burright, Shoreline, WA (US)

(73) Assignee: Amazon Technologies, Inc., Seattle, WA (US)

( * ) Notice: Subject to any disclaimer, the term of this patent is extended or adjusted under 35 U.S.C. 154(b) by 85 days.

(21) Appl. No.: 18/191,464

(22) Filed: Mar. 28, 2023

(51) Int. Cl.
*B65B 59/02* (2006.01)
*B65B 35/30* (2006.01)
*B65B 57/18* (2006.01)

(52) U.S. Cl.
CPC ..... *B65B 59/02* (2013.01); *B65B 35/30* (2013.01); *B65B 57/18* (2013.01)

(58) Field of Classification Search
CPC ..... B65B 59/02; B65B 59/001; B65B 59/003; B65B 35/30; B65B 57/18; B65B 2210/04; B65B 5/024; B65B 5/06
See application file for complete search history.

(56) References Cited

U.S. PATENT DOCUMENTS 8,086,344 B1 * 12/2011 Mishra ..... G06Q 10/087 700/214
9,315,344 B1 * 4/2016 Lehmann ..... B65G 61/00
10,556,713 B2 * 2/2020 Langen ..... G06Q 10/08
2003/0083890 A1 * 5/2003 Duncan ..... G06Q 10/087 705/28
2004/0151068 A1 * 8/2004 Carlsruh ..... G01B 11/026 702/156
2008/0092488 A1 * 4/2008 Gabrielsen ..... B65B 55/20 53/115
2008/0141625 A1 * 6/2008 Bilkie ..... B65B 55/20 53/51
2009/0149306 A1 * 6/2009 Durand ..... B65B 5/024 493/355
2009/0173040 A1 * 7/2009 Carlson ..... B65B 55/20 53/503
2011/0016833 A1 * 1/2011 Carlson ..... B65B 57/12 53/473
2012/0206155 A1 * 8/2012 Wang ..... B01L 3/5453 324/649

(Continued)

*Primary Examiner* — Dariush Seif
(74) *Attorney, Agent, or Firm* — Eversheds Sutherland (US) LLP

(57) ABSTRACT

Systems and methods are disclosed for visual indicators for optimized packing of multi-item packages. In one embodiment, an example system may include an optionally bottomless container, a projector, and a controller configured to determine a first size of a first item to be placed in the bottomless container, determine a second size of a second item to be placed in the bottomless container, determine an item arrangement for the first item and the second item, and determine a first position for a first visual indicator. The controller may be configured to determine a second position for a second visual indicator, determine a size for a square to be projected by the projector, and cause the projector to project the first visual indicator at the first position, the second visual indicator at the second position, and the square onto the bottomless container.

20 Claims, 10 Drawing Sheets

(56) References Cited

U.S. PATENT DOCUMENTS

| | | | | |
|---|---|---|---|---|
| 2013/0000252 | A1* | 1/2013 | Pettersson | B65B 5/024 348/46 |
| 2013/0026173 | A1* | 1/2013 | Renjilian | B65B 65/006 221/92 |
| 2013/0067865 | A1* | 3/2013 | Maruo | B65B 61/005 53/461 |
| 2013/0204419 | A1* | 8/2013 | Pettersson | B65B 5/02 700/97 |
| 2013/0247519 | A1* | 9/2013 | Clark | B65B 57/00 53/452 |
| 2014/0067104 | A1* | 3/2014 | Osterhout | G06Q 10/08 703/1 |
| 2015/0005926 | A1* | 1/2015 | Pettersson | B65B 59/001 700/228 |
| 2015/0013277 | A1* | 1/2015 | Brandhorst | B65B 35/52 53/244 |
| 2015/0130592 | A1* | 5/2015 | Lakshminarayanan | G06K 7/10297 340/10.1 |
| 2018/0130015 | A1* | 5/2018 | Jones | G06Q 10/083 |
| 2020/0223570 | A1* | 7/2020 | Lamb | G06Q 10/08 |
| 2021/0103886 | A1* | 4/2021 | Sezaki | B65G 1/137 |
| 2021/0138756 | A1* | 5/2021 | Langen | B31B 50/262 |
| 2021/0261281 | A1* | 8/2021 | Engleman | B65B 49/08 |
| 2022/0119148 | A1* | 4/2022 | Kiessner | B65D 5/4212 |
| 2022/0405697 | A1* | 12/2022 | Kreis | B65B 5/10 |
| 2023/0072273 | A1* | 3/2023 | Komatsu | B65B 3/00 |
| 2023/0390941 | A1* | 12/2023 | Opoku | B25J 11/0045 |

* cited by examiner

VISUAL INDICATORS FOR OPTIMIZED PACKING OF MULTI-ITEM PACKAGES

BACKGROUND

As users increasingly make online purchases, fulfilment of such purchases and other orders may become increasingly complicated. For example, a fulfillment center may have output of upwards of one million packages per day. With such demands, efficiency of logistics related to processing orders and packages may be important. Accordingly, improvements in various operations of order fulfillment, such as improvements to picking technology, sorting technology, packing technology, and so forth may be desired, such that manual efforts can be redirected to different tasks. Moreover, in some instances, single items may be packed in containers for shipment. However, such items may be of different shapes and sizes. Accordingly, custom sized containers for shipping may be desired.

Figure 1:
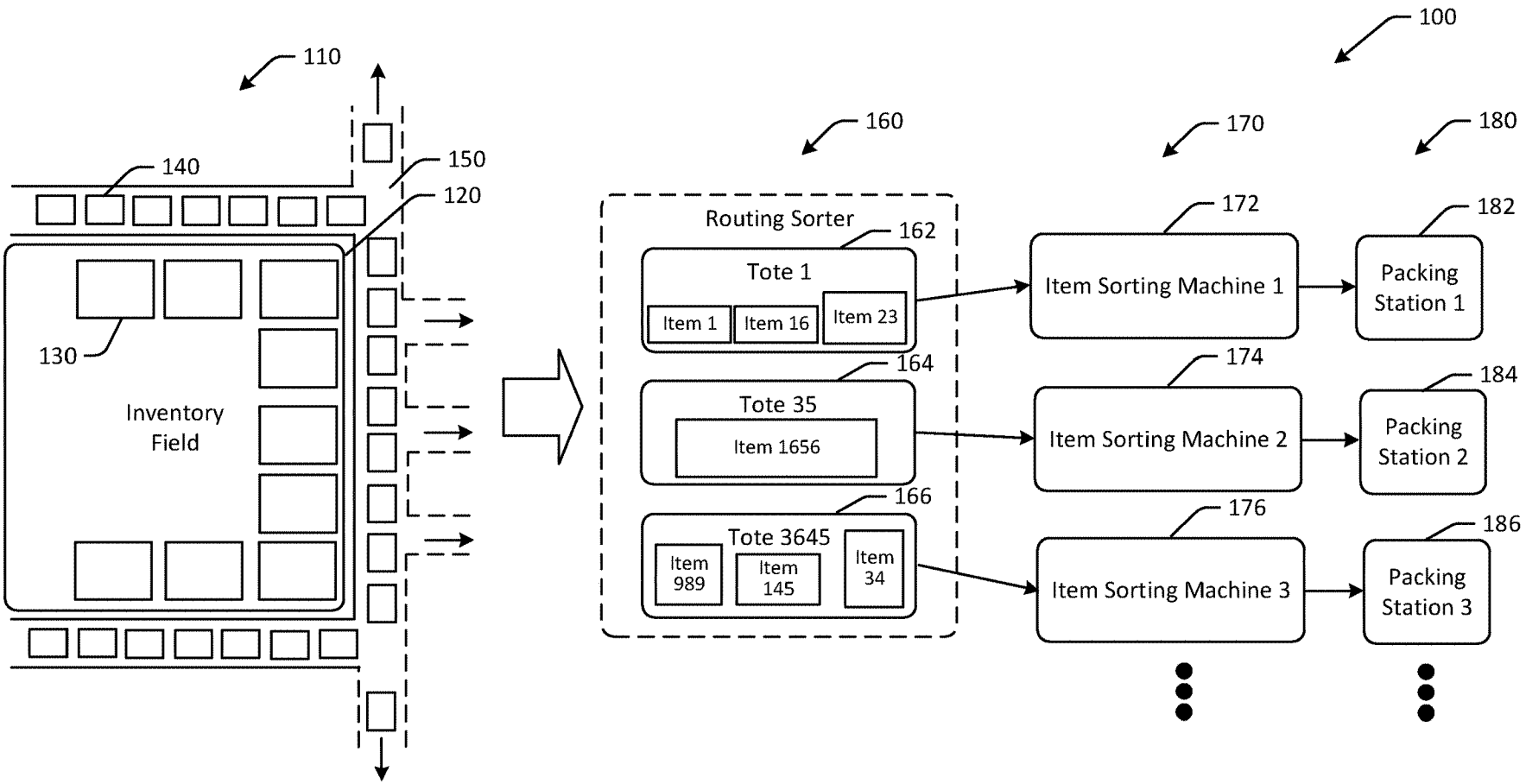
FIG. 1 is a hybrid schematic illustration of an example use case for visual indicators for optimized packing of multi-item packages and an example process flow in accordance with one or more embodiments of the disclosure.

The detailed description is set forth with reference to the accompanying drawings. The drawings are provided for purposes of illustration only and merely depict example embodiments of the disclosure. The drawings are provided to facilitate understanding of the disclosure and shall not be deemed to limit the breadth, scope, or applicability of the disclosure. The use of the same reference numerals indicates similar, but not necessarily the same or identical components. Different reference numerals may be used to identify similar components. Various embodiments may utilize elements or components other than those illustrated in the drawings, and some elements and/or components may not be present in various embodiments. The use of singular terminology to describe a component or element may, depending on the context, encompass a plural number of such components or elements and vice versa.

DETAILED DESCRIPTION

Overview

Fulfillment centers may be used to fulfill online purchases and other orders. For example, fulfillment centers may include product inventory that may be pulled when an order for a particular product or multiple products is placed. In some instances, the product(s) may be packed and shipped from the fulfillment center. However, the process of obtaining the product(s), packing the product(s), and shipping the product(s) may be complicated due to the amount of inventory, the number of orders to process, the size of the fulfillment center, and/or other factors. In addition, a portion of the fulfillment center designated for packing or shipping may be different than the portion of the fulfillment center designated for holding product inventory. As a result, transportation of products in an order may be time consuming. In addition, a number of different types of containers may be used to pack items into for shipping. For example, container types may include boxes, bags, flexible containers (e.g., paper mailers, bubble wrap mailers, etc.) and/or other types of containers. Some containers may be have fixed sizes or dimensions, and may therefore be larger than an item that is packed inside, resulting in the use of bubbles, packing paper, or other fillers to reduce a likelihood of damage to the item during transit. In addition, certain containers may be formed of non-recyclable materials, such as certain types of plastic. Accordingly, custom sized or right-sized containers that are made of recyclable may be desired so as to not only reduce environmental impact, but also to reduce waste and packaging material consumption due to custom sized containers for items, thereby removing the need for fillers and avoiding containers that are too big relative to the size of the item(s) in the container.

For packages with multiple items, such as two or more items, creating right-sized or custom-sized packages may be difficult due to placement of the items when determining package size and/or when forming a custom-sized package for the items. Such item arrangement may be performed with manual input. However, even with manual input, limitations of package formation equipment, movement of items during packing, and/or other issues may complicate the process. In contrast, forming custom-sized packages for individual items may be relatively easier and may not require any manual input.

Embodiments of the disclosure include systems and methods for providing visual indicators for optimized packing of multi-item packages. Using the visual indicators, manual operators may arrange items in an optimal manner for packing into a custom-sized package by automated packing equipment. Some embodiments include a reusable bottomless container with adjustable internal walls and/or adjustable sidewalls, where the visual indicators can be used to project optimal positioning of the adjustable sidewalls. Operators can then move the adjustable sidewalls into positions aligned with the projected visual indicators. The visual indicators may also include a height indicator that prevents operators from unnecessarily stacking items to be packed beyond an optimal height. In other embodiments, the adjustable sidewalls may be automatically moved via one or more actuators. Accordingly, waste in the form of oversized packaging can be reduced, and throughput can be increased due to increased compliance with automated packing equipment restrictions.

Embodiments of the disclosure can be used with any suitable type of custom-sized package, such as roll-formed containers for shipping that may improve packing quality (e.g., items may not move within the container as the container is custom sized around the item, etc.), and reduce environmental impact by providing a recyclable package that can be recycled after delivery. Some embodiments may produce roll-formed containers to ship items without waste or scrap, providing environmental benefits. Certain embodiments include custom container formation equipment that can be used to produce containers that are sized based at least in part on dimensions of an item to be packed inside the container. The containers may be formed of a single sheet of roll-formed material, such as a fiber-based material, at least partially fiber-based material, a paper-based material (e.g., unpadded cardboard, single-sided or double-sided corrugate, a non-Gaussian material, etc.) that is formed around the item to be packed. The item may be placed onto a portion of the recyclable material and the container may be formed using one or more rollers and folders that can be used to form a number of different container configurations, including configurations with inward-facing gussets, outward-facing gussets, bent sidewalls, round sidewalls, flat sidewalls, and so forth, along with different types of seals. Containers may be output at a rate of up to or greater than 2,000 units per hour. Some embodiments include camera assemblies or other sensor assemblies that can be used to determine item dimensions and placement. To facilitate scalability, certain embodiments may produce a number of containers at substantially the same time, or during an overlapping timeframe, as discussed with respect to FIGS. 2A-2B. Some embodiments include optimized process flows for processing of orders at fulfillment centers, as well as process flows or methods to increase speed of consolidating products in a single-item or multi-item order as a result of improved speed in placing items into containers and removing items from containers. As a result, throughput of fulfillment centers may be improved, and/or logistics of fulfillment center operations may be less complicated.

As a result of the improve functionality provided by the systems and methods described herein, throughput of the processing of items at the fulfillment center may be increased. Some embodiments include optimized process flows for processing of orders at fulfillment centers, as well as process flows or methods to increase speed of consolidating products in a multi-item order as a result of improved speed in transportation of items and/or containers. As a result, throughput of fulfillment centers may be improved, and/or logistics of fulfillment center operations may be less complicated.

Referring to FIG. 1, an example use case 100 for visual indicators for optimized packing of multi-item packages and an example process flow in accordance with one or more embodiments of the disclosure. Although discussed in the context of online orders, other embodiments may be directed to any suitable use case where objects are packed into containers, such as instances where items for single item orders that are picked from inventory and placed into flexible containers for shipment, and so forth.

In FIG. 1, a fulfillment center may include an inventory field 110, a routing sorter 160, one or more item sorting machines 170, and one or more packing stations 180. The inventory field 110 may be include a storage platform, or a portion of the fulfillment center at which products picked from product inventory are placed. Robots may be used to pick products from inventory and to deliver to the robotic storage platform in some instances, while in other instances, manual labor or a combination thereof may be used to pick products. The picking process at the robotic storage platform may include locating a product in an order, obtaining the product, and sending the product to a robotic storage platform, such as via a conveyor belt. In the illustrated embodiment, products at the robotic storage platform may be placed in a container, such as a tote.

The inventory field 110 may include multiple items that are in inventory. The items may be used to fulfill orders. The inventory field 110 may be a robotic field in some instances. One or more picking stations 130 may be positioned along a perimeter 120 of the inventory field 110. The picking stations 130 may be manually operated or may include robotic components, or a combination thereof. In some instances, picking of items from the inventory field 110 may be completed by robots, where the items are delivered to the picking stations 130 after being retrieved from the inventory field 110. Any number of picking stations 130 may be included, and the picking stations 130 may be located in a different position than that illustrated in FIG. 1.

One or more conveyors 150 may be disposed about the inventory field 110. For example, conveyors 150 may be disposed along the perimeter 120 of the inventory field 110. The conveyors 150 may run adjacent to the picking stations 130 in some embodiments. Any suitable conveyor configuration may be used. In the illustrated example, the conveyors 150 may include belts or rollers that run alongside the picking stations 130 and include one or more paths to one or more routing sorters.

The conveyors 150 may be used to transport one or more totes 140. For example, as totes 140 move along the conveyors 150, items may be moved from the picking stations 130 into respective totes 140. The totes 140 may be associated with particular item sorting machines, and may be moved using the conveyors 150 to a routing sorter 160.

The routing sorter 160 may be configured to route, divert, or otherwise guide certain totes to an item sorting machine. The routing sorter 160 may include any combination of ramps, slides, rollers, arms, guides, and/or other components to route totes to a particular item sorting machine. At the routing sorter 160, totes including products that have been picked may be routed to the appropriate or designated item sorting machine. For example, the routing sorter 160 may determine an identifier associated with the tote, and may determine an item sorting machine associated with the tote using the identifier. The routing sorter 160 may route or direct the tote to the appropriate item sorting machine.

A number of item sorting machines 170 may be coupled to the routing sorter 160. For example, a first item sorting machine 172, a second item sorting machine 174, a third item sorting machine 176, and so forth may be coupled to the routing sorter 160. The routing sorter 160 may guide totes to the item sorting machines to which they are assigned. For example, a first tote 162 may include item 1, item 16, and item 23, and may be assigned to the first item sorting machine 172. The routing sorter 160 may therefore route the first tote 162 to the first item sorting machine 172 for sortation of the respective items. A second tote 164 may include item 1656, and may be assigned to the second item sorting machine 174. The routing sorter 160 may therefore route the second tote 164 to the second item sorting machine 174 for sortation of the item. A third tote 166 may include item 989, item 145, and item 34, and may be assigned to the third item sorting machine 176. The routing sorter 160 may therefore route the third tote 166 to the third item sorting machine 176 for sortation of the respective items.

Some or all of the item sorting machines may be associated with one or more packing stations 180 that may be used to pack items into a shipment when a single-item or multi-item order is complete. For example, the first item sorting machine 172 may be coupled to a first packing station 182, the second item sorting machine 174 may be coupled to a second packing station 184, the third item sorting machine 176 may be coupled to a third packing station 186, and so forth. The item sorting machines may be configured to receive items from totes that have one or more, or multiple, items. The number of totes and/or the number of items associated with respective item sorting machines may be balanced, and multiple totes may be routed to the first item sorting machine 172 and the second item sorting machine 174 at the same time.

Some of the packing stations may be configured to pack items for single-item orders into containers for shipment, such as custom-sized roll-formed containers, instead of pre-sized containers with fixed dimensions. In one example embodiment, container systems as described herein may be used to transport items for multi-item orders to packing stations, such that the items are placed into custom sized roll-formed containers and transported downstream for shipment.

At any of the stages of the example fulfillment process of FIG. 1 where handling of objects is used, such as to pick items from inventory, place items in totes, remove items from totes, place items into bins, remove items from bins, place items into boxes for shipping, and so forth, robotic manipulators may be used. As a result, manual effort can be redirected to other tasks.

Embodiments of the disclosure include custom-sized containers, such as roll-formed containers, for shipping. Certain embodiments may reduce waste and improve shipment quality by providing custom sized containers, and may improve processing speed and/or throughput of fulfillment centers. Certain embodiments may improve performance of mechanical equipment for packing, sortation, and/or consolidation of items. While described in the context of online orders, aspects of this disclosure are more broadly applicable to other forms of object handling.

Example embodiments of the disclosure provide a number of technical features or technical effects. For example, in accordance with example embodiments of the disclosure, certain embodiments of the disclosure may improve packing quality, reduce a likelihood of item or container damage, and improve processing speed, throughput, and/or efficiency of fulfillment centers. The above examples of technical features and/or technical effects of example embodiments of the disclosure are merely illustrative and not exhaustive.

One or more illustrative embodiments of the disclosure have been described above. The above-described embodiments are merely illustrative of the scope of this disclosure and are not intended to be limiting in any way. Accordingly, variations, modifications, and equivalents of the embodiments disclosed herein are also within the scope of this disclosure. The above-described embodiments and additional and/or alternative embodiments of the disclosure will be described in detail hereinafter through reference to the accompanying drawings.

Illustrative Embodiments and Use Cases

Figure 2A:
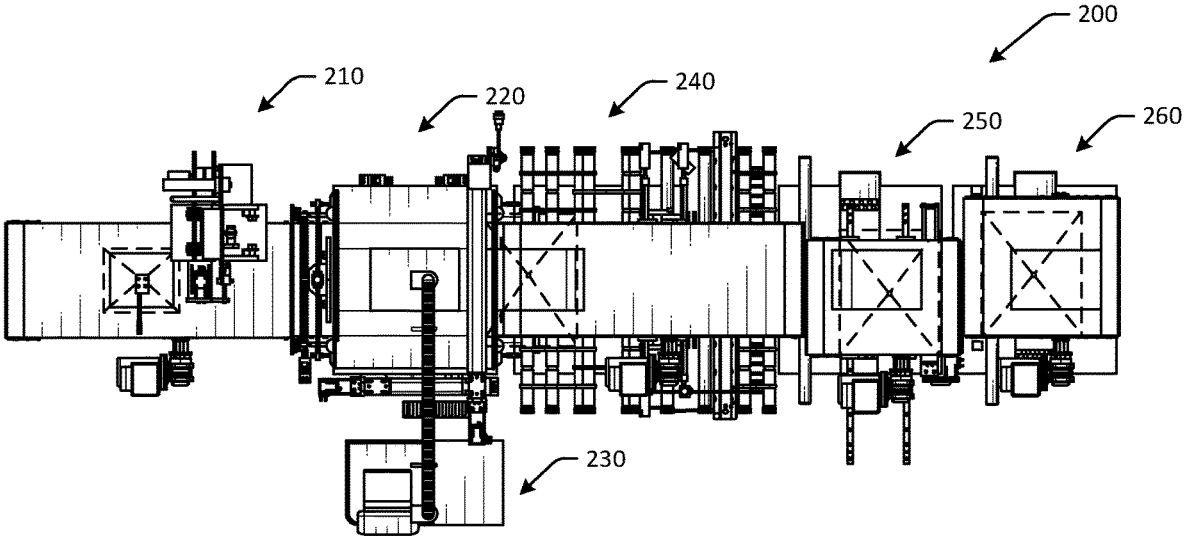
FIGS. 2A-2B are schematic illustrations of an example custom container generation system and an example custom container in various views in accordance with one or more embodiments of the disclosure.
Figure 2A:
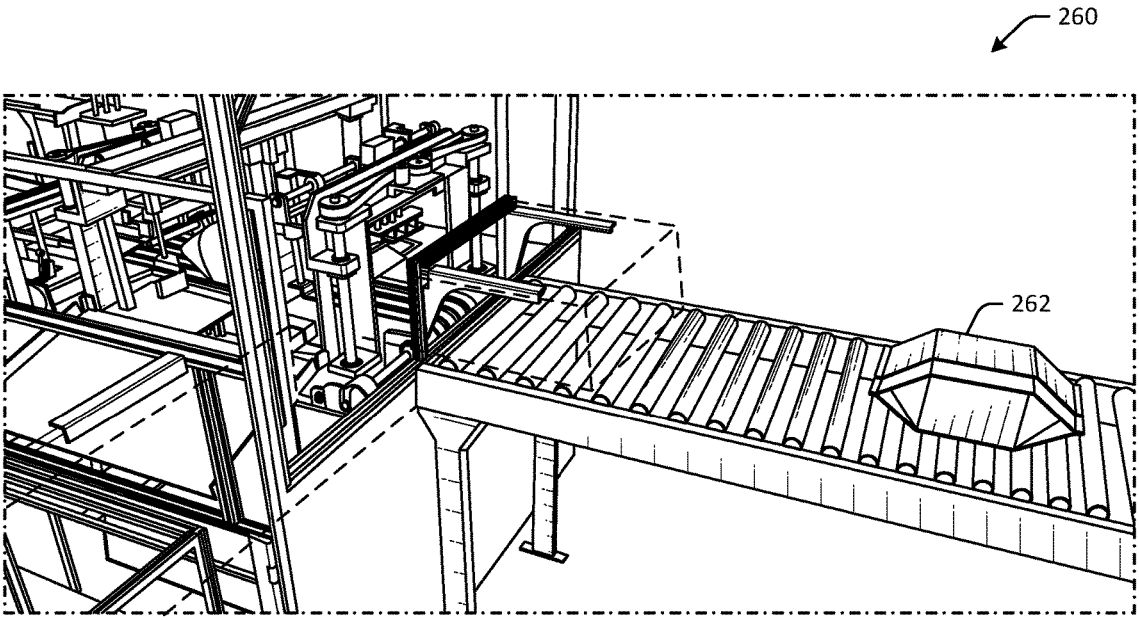
Figure 2B:
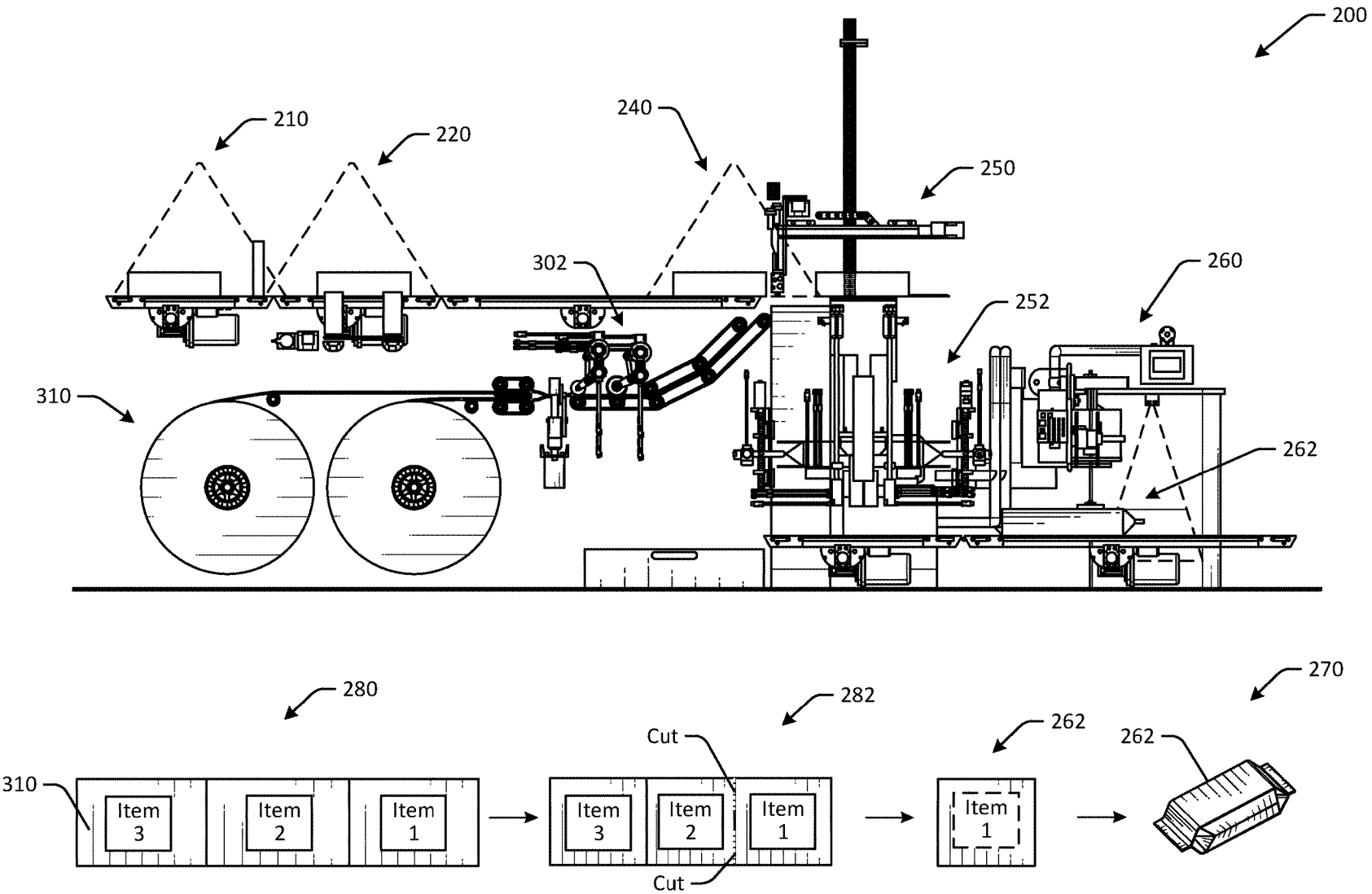

FIGS. 2A-2B are schematic illustrations of an example custom container generation system 200 and an example custom container 262 in various views in accordance with one or more embodiments of the disclosure. Other embodiments may include additional or fewer components. The illustrations of FIGS. 2A-2B may not be to scale, and may not be illustrated to scale with respect to other figures. The custom container generation system 200 illustrated in FIGS. 2A-2B is for illustrative purposes only, and other embodiments may have a different configuration. The custom container generation system 200 may be used at, for example, any of the packing stations discussed with respect to FIG. 1.

In FIG. 2A, the custom container generation system 200 may be configured to receive items for packing, and to pack the items into custom sized roll-formed containers, such as the roll-formed container 262. Other types of custom-sized containers may be used. Items may be inducted at the custom container generation system 200 and measured at a measurement portion 210 of the custom container generation system 200. One or more sensors, such as infrared LEDs, light arrays, cameras, and/or other sensors, may be used to determine various dimensions of the item, such as a height, a width, and/or a length of the item. In some embodiments, based on the dimensions of the item, the custom container generation system 200 may determine whether a roll-formed container can be formed for the item. For example, if the item has a height that exceeds a threshold, the custom container generation system 200 may be unable to produce a roll-formed container for the item. Accordingly, such items may be ejected from the custom container generation system 200 at a centering portion 220 of the custom container generation system 200. For example, ejected items may be pushed using an arm or conveyed using a conveyor onto an ejected item portion 230 of the custom container generation system 200. Items for which a roll-formed container can be formed may be centered on a conveyor at the centering portion 220 by the arm used to eject items (e.g., the same arm may be used for centering and/or ejecting items, etc.). The custom container generation system 200 may include a container formation portion 240 where a packaging material is scored and creased to form a container around the item. At an adhesive application portion 250 of the custom container generation system 200, adhesive may be applied to the packaging material, and the roll-formed container may be folded and sealed at a folding and sealing portion 260 of the custom container generation system 200, a shipping label may be applied and the package may be optionally compressed to ensure adhesive bonding, and the completed roll-formed container 262 or package may be output from the custom container generation system 200. The folding and sealing portion 260 is partially depicted in side view in FIG. 2A and illustrates the completed roll-formed container 262 with inward facing gussets being output from the custom container generation system 200 ready for shipment.

A side view of the custom container generation system 200 is depicted in FIG. 2B. The custom container generation system 200 may include one or more webs or rolls of packaging material 310 that may be automatically spliced when one roll or web is complete, so as to avoid downtime. One or more scoring devices 302 configured to score crease lines on the packaging material 310 may be included. A sealing portion 252, which may include one or more compress bars and/or gusset forming pins or supports may be disposed vertically lower than the adhesive application portion 250 in some embodiments, so as to reduce a footprint of the custom container generation system 200.

An example flow of items in the custom container generation system 200 is depicted in FIG. 2B, where the items are disposed on unwound packaging material 310 as the packaging material is routed through the custom container generation system 200. At a first instance 280, items may be input at the custom container generation system 200 for packing. One or more robotic arms may be used to place the items onto a first conveyor for an induction process into the custom container generation system 200. During the induction process, one or more cameras or other sensors, such as LIDAR sensors, depth sensors, infrared LEDs, and so forth may be used to determine one or more dimensions of the items. For example, a first sensor may be used to capture one or more top-down images of the items, and a second sensor may be used to capture one or more side-view images or dimensions of the items. The sensor(s) may generate data that is used to determine one or more dimensions of the items. For example, the sensor(s) may be depth cameras or depth sensors used to generate data points that can be processed to determine one or more dimensions of the items. The items may flow along the first conveyor onto a portion of packaging material 310. For multi-item packages, a bottomless container may be used to arrange the items prior to induction into the machine, as discussed with respect to FIGS. 3A-3B. The packaging material 310 may be a roll-formed packaging material, such as corrugate, or a different packaging material, such as a non-Gaussian packaging material, an unpadded packaging material, or the like. In some embodiments, any material that can be creased or bent can be used. Although dual rolls of the packaging material 310 is depicted, other embodiments may include additional or fewer rolls of packaging material, and some or all of the packaging materials may have different widths, such as widths of 27 inches and 35 inches to provide added flexibility in packaging items of different dimensions. The packaging material 310 may flow along a second conveyor that moves at the same speed, or substantially the same speed, as the first conveyor.

The items may therefore flow seamlessly from the first conveyor onto the packaging material 310 on the second conveyor. On the second conveyor, the items may be imaged during a positioning confirmation process at the centering portion 220. During the positioning confirmation process, a position of the items on the packaging material 310 may be determined using one or more sensors. The position of the items may be compared to a predetermined boundary to determine whether the items is sufficiently positioned at or near a center of the packaging material 310. If a positioning adjustment is needed, a second robotic arm may be used to adjust or reposition the items on the packaging material 310.

Based at least in part on the dimensions of the items, a length of packaging material to be used for packaging the items may be determined. The length of packaging material may be adjusted by dispensing the determined amount of packaging material 310 from the roll of packaging material.

In addition to the length of packaging material, a width between fold lines that are to be made on the packaging material 310 may be determined. The width between fold lines may correspond to a width of the items. The fold lines may be creases, score lines, perforations, or other features that facilitate bending of the packaging material 310. In some embodiments, fold lines may be embossed, serrated, perforated, texturized, or otherwise deformed. To impart the fold lines onto the packaging material 310, one or more adjustable rollers, rolling dies, or dies may be used at the scoring device(s) 302. As the packaging material 310 is fed forward, in addition to roll forming, partial width slitting may optionally occur as the packaging material 310 contacts the rolling dies. The slits may be cut, for example, with one or more rotary blades, with one cut on either side of the material, where the slitting process is performed while the packaging material 310 is stationary (e.g., between roll forming processes, etc.). The rolling dies may be adjustable in one or more lateral direction to increase or decrease separation between a first rolling die and a second die rolling die of the adjustable end scoring assembly. The rolling dies may move along a shaft. The rolling dies may have any suitable pattern, such as Y-shaped patterns, triangular patterns, diamond patterns, circular patterns, linear patterns, or other types of patterns. In some embodiments, the rolling dies may be heated, which may increase the number of different types of packaging materials that can be used with the custom container generation system 200. In some embodiments, the rolling dies may be used on the packaging material 310 before the items is placed onto the packaging material 310, whereas in other embodiments, individual rolling dies may be used to create the fold lines on the packaging material 310 after the item is positioned on the packaging material 310. In some embodiments, to effect the fold lines on the packaging material 310, a single roller may be used to press the packaging material 310 against one or more rolling dies that may be statically positioned. In other embodiments, the rolling dies may be movable. More than one set of rollers and/or rolling dies may be used to impart the fold lines onto the packaging material. As the packaging material 310 is unwound and flows toward the second conveyor, hot melt or another adhesive may be applied at the adhesive application portion 250. A shipping label may be applied and may be verified using a scanner or other hardware.

After positioning of the items on the packaging material 310 is confirmed to be acceptable, or after the item is repositioned and then confirmed to be within the predetermined boundary, an adhesive or sealant, such as a hot melt glue, pressure-sensitive adhesive, tape, glue, thermal sealing component, or other adhesive or sealant may be applied about one or more edges and/or the width of the packaging material. For example, in some embodiments, adhesive may be applied about three sides of the packaging material 310. In other embodiments, adhesive may be applied along less than three sides of the packaging material 310 while the packaging material 310 and the item are in motion, so as to increase throughput. To apply the adhesive, the adhesive may be sprayed, applied in a beaded or spiral pattern, or otherwise distributed along one or more surfaces of the packaging material 310. In some embodiments, before the items is placed on the packaging material 310, a portion of the adhesive may be applied. The length of adhesive may correspond to the determined length of packaging material 310 to be used for packaging of the items.

After the adhesive is applied, the process may continue to the folding and scaling portion 260 at which the packaging material may be folded around the item and optionally compressed to seal the package via bonding of the adhesive. In some embodiments, the cutting and folding station 260 may be a walking jaw and may create two parallel seals at the same time or substantially the same time (e.g., consecutive seals, etc.). In an example, one seal may be at the end of a package, and another seal may be the front end of an adjacent package. The cutting and folding station 260 may include an integrated cutting/severing blade, which may be used to cut or trim the unglued area in between parallel seals. As the walking jaw or cutting and folding station 260 slides along the packaging material 310, space between seals may be trimmed as the seals are formed. As the packaging material is folded, an amount of overlap between a first side and a second side may be adjusted so as to form a package that custom fits the items.

After the sides are folded, the sides may be pressed or compressed to cause the adhesive to bind the package edges and the overlap together to form the sealed package 262 about the items. In some embodiments, the folders may be used to form inward-facing gussets depending on a type of package that to be formed. The sealed package 262 may be pushed onto or otherwise fed onto a takeaway container for downstream processing of the sealed package 262.

The custom container generation system 200 may therefore be an item packing station that includes a number of components. For example, the custom container generation system 200 may include the first conveyor configured to transport the items for packing, and a second conveyor configured to transport the packaging material 310. The second conveyor may be disposed adjacent to the first conveyor, and both the first conveyor and the second conveyor may be configured to move at substantially the same speed or at the same speed, so as to facilitate handoff between the respective first conveyor and the second conveyor. The custom container generation system 200 may include a number of cameras or other sensors that may be used along various points and/or positions. For example, the custom container generation system 200 may include a first sensor system configured to image the items. The first sensor system may include one or more cameras or other sensors and may be configured to generate data used to determine dimensions of the items. A second sensor system may be configured to image the items on the packaging material 310 to determine whether positioning of the items falls within a predetermined boundary. In an embodiment, the custom container generation system 200 may include two sensors used to determine item dimensions, one sensor to determine positioning of the item prior to handoff of the item, and another sensor to determine correct positioning of the item on the packaging material.

The custom container generation system 200 may include a set of one or more rolling dies configured to crease or otherwise impart formations on the packaging material 310. The custom container generation system 200 may include a controller configured to determine, using the first sensor system, a first dimension of the items, such as a width or a height, and to determine a length of packaging material 310 to use for packing the items, where the length is determined using the first dimension. The controller may be configured to cause a first crease line and a second crease line to be formed on a surface of the packaging material 310 using the set of one or more rolling dies. The controller may be configured to cause a first side of the packaging material to be folded over the items, and to cause a second side of the packaging material to be folded over the first side of the packaging material to form an overlapping portion. The width of the overlapping portion may be adjusted based at least in part on the size of the items. The controller may be configured to cause ends of the packaging material to be pressed to form a package, where the item is disposed in the package.

Accordingly, in one embodiment, the system may include a controller. A first sensor system may be used to determine a first dimension of a first item for packing into a custom sized container. For example, the controller may cause the first item to be transported to the packaging material via a conveyor moving at a first speed, wherein the packaging material is moving at the first speed when the first item flows onto the packaging material. The first sensor system may include one or more cameras, such as depth cameras or other sensors, in different positions. In one embodiment, a sensor may be coupled to a robotic arm and used to image various angles of the first item to determine the first dimension. The first dimension may be a height, length, or width of the first item. In some embodiments, more than one sensor may be used to determine one or more dimensions of the first item. Data generated using the respective sensors may be used to determine one or more dimensions of the item.

The system may determine, using the controller, a length of packaging material to use for packing the first item based at least in part on the first dimension. For example, based at least in part on a length of the first item, a length of packaging material may be determined that corresponds to the length of the item. In another example, the width or height of the first item may be used to determine the length of packaging material. The determined length may be used to determine how much packaging material is to be unrolled or otherwise used to package the first item. For example, the controller may cause the packaging material to advance from a roll of packaging material until the length of packaging material to use for packing the first item is advanced.

The system may cause a first crease line and a second crease line to be formed on a surface of the packaging material. For example, the controller may cause one or more rollers or rolling dies to contact the packaging material and to impart crease lines onto the packaging material. Crease lines may be fold lines, score lines, perforations, or other lines that form depressions in a surface of the packaging material, and may facilitate bending of the packaging material. Depending on the type of packaging material, the packaging material may not crease, and when unsealed, may return to a substantially flat shape. The rollers or rolling dies may be adjustable to form crease lines with various separation distances, so as to accommodate items of different sizes. In some instances, the rollers or rolling dies may be heated to be effective with an increased number of packaging materials. In some embodiments, in addition to crease lines, tessellations or other patterns may also be formed adjacent to the crease lines to form flexible sidewalls of the package. An adhesive may be applied about one or more portions of the packaging material before or after the crease lines are formed. For example, the controller may cause, using one or more adjustable rollers, a first crease pattern to be formed adjacent to the first crease line on the surface of the packaging material, and, using the one or more adjustable rollers, a second crease pattern to be formed adjacent to the second crease line on the surface of the packaging material.

The system may cause a first side of the packaging material to be folded over the first item. For example, the controller may cause one or more folding assemblies to fold a first side of the packaging material over a top of the first item. Before the first side is folded, the controller may determine, using a second sensor system, whether the first item is positioned in a first position on the packaging material that exceeds a predetermined boundary. If the boundary is exceeded, the first item may be repositioned using a robotic arm or other hardware, or a notification for manual intervention may be generated. For example, the controller may cause the first item to be repositioned from the first position to a second position within the predetermined boundary. Similarly, a second side of the packaging material may be caused to be folded over the first side of the packaging material to form an overlapping portion. For example, the controller may cause one or more folding assemblies to fold a second side of the packaging material over the first side of the packaging material to form an overlapping portion using one or more folders. The amount of overlap may be adjusted based on one or more dimensions of the first item, thereby forming a custom sized container. A height of the package may be adjustable by adjusting an amount of overlap of the overlapping portion. In some embodiments, to form certain types of packages, such as flat mailers or envelopes, there may not be an overlapping portion for the package. Instead, a first side may be folded over the other, and the second side may not be folded.

Ends of the packaging material may be caused to be sealed to form a package, where the first item is disposed in the package. One or more compress bars or other equipment may be caused, by the controller, to add pressure to the ends and/or the overlapping portion of the packaging material to seal the package. The remaining portion of the packaging material may be cut and the sealed package may be transferred for downstream processing. Sealing may include sewing, pressing, folding, or otherwise closing the package.

Figure 3A:
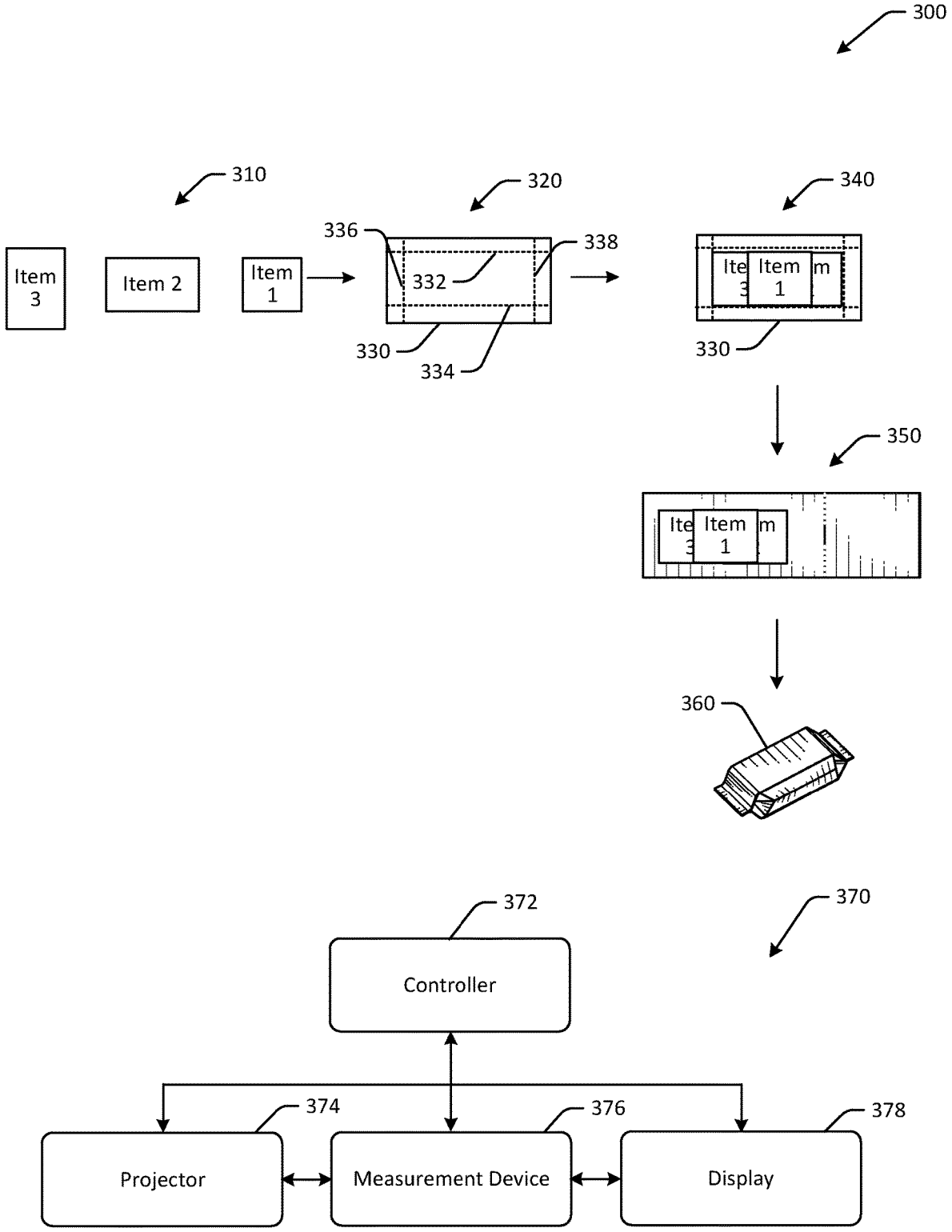
FIGS. 3A-3B are schematic illustrations of an example visual indicator system and example process flow in accordance with one or more embodiments of the disclosure.
Figure 3B:
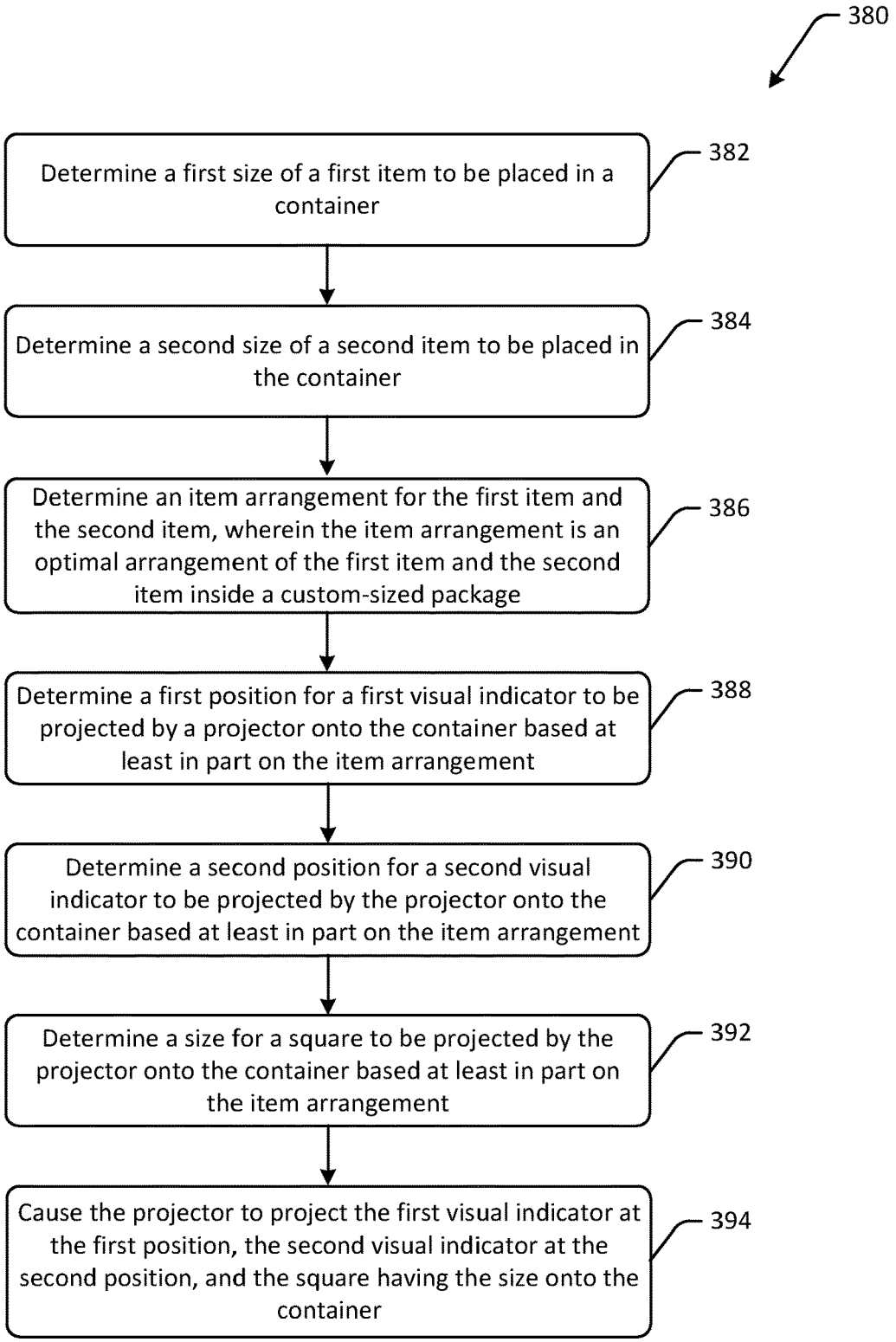

FIGS. 3A-3B are schematic illustrations of an example visual indicator system and example process flow in accordance with one or more embodiments of the disclosure. Other embodiments may include additional or fewer components. The illustrations of FIGS. 3A-3B may not be to scale, and may not be illustrated to scale with respect to other figures. The components illustrated in FIGS. 3A-3B are for illustrative purposes only, and other embodiments may have a different configuration. The components illustrated in FIGS. 3A-3B may be the same as some of the components discussed with respect to FIGS. 1-2B.

In FIG. 3A, an example flow 300 of items for packing into a multi-item package is depicted. Items 310 for the multi-item order may be aggregated and may include Item 1, Item 2, and Item 3. The items 310 may be dimensioned using a measurement device 376, such as one or more sensors, e.g., a 3D scanner, a camera, and/or another type of device. Based at least in part on sizes of the items 310, a controller 372 may determine a corresponding package size for a custom-sized package in which to place the items 310. Based at least in part on the package size, the controller may determine an item arrangement for the items 310. For example, Item 1 may be placed on top of Item 2 and Item 3. Other arrangements may be possible and may be determined based at least in part on the package size. Using the item arrangement, the controller may cause a projector 374 disposed on top of, or otherwise overhead, to project one or more visual indicators, such as one or more dots, lines, waves, rectangles or geometrical shapes, or any other type of visual indicator representing locations or positions to which adjustable sidewalls should be moved of a bottomless container 320.

The bottomless container 320 may be disposed on a conveyor and may be used to position the items 310 for packaging. The bottomless container 320 may include a first sidewall, a second sidewall, a third sidewall, and a fourth sidewall, one or more of which has an adjustable position. The projector 374 may project a first visual indicator 336 for a first sidewall position, a second visual indicator 338 for a second sidewall position, a third visual indicator 332 for a third sidewall position, and a fourth visual indicator 334 for a fourth sidewall position. Other embodiments may have less than four adjustable sidewalls and the projector 374 may therefore project fewer visual indicators. For example, the items 310 may be arranged in a corner of the bottomless container 320 instead of a center of the bottomless container 320. The projected visual indicators may be projected onto an upper surface 330 of the bottomless container 320. Once the sidewalls are aligned with the projected visual indicators, a display 378 may optionally provide an approval notification indicating the items 310 may be arranged in the bottomless container 320 between the sidewalls, as depicted in configuration 340. At configuration 350, the bottomless container 320 may be removed and the items may be sent downstream for packing into a custom-sized package 360.

In FIG. 3A, a schematic illustration 370 depicts the controller 372, which may be in communication with the projector 374, the measurement device 376, and the optional display 378. Other embodiments may include additional, fewer, and/or different components than those depicted in FIG. 3A. The projector 374 may be an image projector configured to output light having at least one color. The controller 372 may optionally be an edge compute device. The measurement device 376 may be configured to measure items and/or determine sidewall positioning and/or compliance with projected visual indicators. In some embodiments, when a multi-item order is designated to be packed, the controller 372 may determine an optimal sizing solution and a corresponding projection for that unique multi-item order. The controller 372 may send the projection data to the projector 374, which provides the optimal adjustable internal wall positioning using visual indicators for the length and width. The projection may include a central square projected to represent the height of the order, as discussed with respect to FIG. 3B. If the bottomless container 320 is symmetric, the image projector can be physically centralized on the containers location when being used. If the bottomless container 320 is asymmetric (e.g., items are placed in a corner of the container instead of the center), the projector 374 may also be centralized on the containers location when being used, but the projected image can be vertically/horizontally adjusted by a command from the controller 372 to the projector 374 centering on the optimal size. In some embodiments, such as in the case of an asymmetric container, image key-stoning can be used to ensure that the height projection will be uniform across the adjustable internal walls.

While an operator is adjusting the sidewalls of the bottomless container 320, the measurement device 376 may monitor the real time position of the walls. An indication of correct positioning may be presented to the operator via the display 378. In other embodiments, a color of light emitted by the projector 374 may change to indicate correct positioning. For example, the projected visual indicators may change from red light to green light, or from one color to a different color. Color of the projected square may also change from one color to another to indicate height compliance. In the event an error is detected in positioning of the sidewalls, the controller 372 may determine whether the error is significant (e.g., whether the sidewalls are within a threshold distance from a correct position, such as 1 inch or another threshold, whether the height is within a threshold amount from the correct height, such as 0.5 inch or another threshold, etc.). If an error is significant, feedback to correct the error can be provided at the display 378. If the error is not significant, the items may be moved downstream and a warning or other improvement feedback may be presented to the operator for future improvement at the display 378.

In FIG. 3B, a process flow 380 may be executed by a local or remote controller of a custom-sized package generation system or a connected computer system. The package generation system may include memory having computer-executable instructions, and one or more computer processors configured to access the memory and execute the computer-executable instructions to perform one or more operations. In some embodiments, the system may include a container, such as a bottomless container or a container having a bottom, the container having one or more moveable sidewalls, such as a first moveable sidewall and a second moveable sidewall. The system may include the projector 374 and a controller configured to perform various operations.

At block 382, the controller may determine a first size of a first item to be placed in the container. For example, the controller may use one or more sensors, such as the measurement device and/or other devices to determine one or more dimensions of the first item, such as length, height, width, weight, or another dimension. In some embodiments, size data may be determined by identifying the item via a barcode or other identifier and retrieving information from a database. The container may be used to ensure consistent and/or correct positioning of items for packing by the custom-sized package generation system.

At block 384, the controller may determine a second size of a second item to be placed in the container. The second item may be another item in a multi-item order. For example, the controller may use one or more sensors, such as the measurement device and/or other devices to determine one or more dimensions of the first item, such as length, height, width, weight, or another dimension. In some embodiments, size data may be determined by identifying the item via a barcode or other identifier and retrieving information from a database. The container may be used to ensure consistent and/or correct positioning of items for packing by the custom-sized package generation system.

In some embodiments, based at least in part on the item sizes, the controller may determine a set of available package sizes for packages that can be formed by the custom-sized package generator, and may select a package size from the set of available package sizes to be generated by the packing system based at least in part on the first size and the second size.

At block 386, the controller may determine an item arrangement for the first item and the second item, wherein the item arrangement is an optimal arrangement of the first item and the second item inside a custom-sized package. For example, the controller may determine that the first item and second item are to be placed adjacent to each other in a horizontal or vertical arrangement, the first item is to be placed on top of the second item, or another item arrangement that complies with the packing system or custom-sized package generation system requirements and other downstream system requirements, as well as optimizes use of space inside the custom-generated package.

At block 388, the controller may determine a first position for a first visual indicator to be projected by the projector onto the container based at least in part on the item arrangement. For example, the controller may determine lines or another type of visual indicator that correspond to sidewall placement for the item arrangement, and may determine positioning of the line relative to a current sidewall position. The first line may be a horizontal line. More than one horizontal line may be formed depending on, for example, whether the container is used to place items in the center or at a corner.

At block 390, the controller may determine a second position for a second visual indicator to be projected by the projector onto the container based at least in part on the item arrangement. For example, the controller may determine lines or another type of visual indicator that correspond to sidewall placement for the item arrangement, and may determine positioning of the line relative to a current sidewall position. The second line may be a vertical line. More than one vertical line may be formed depending on, for example, whether the bottomless container is used to place items in the center or at a corner.

At block 392, the controller may determine a size for a square to be projected by the projector onto the container based at least in part on the item arrangement. For example, the projected may be used to project a square onto the center or a corner of a bottomless container, such that the square appears on the adjusted sidewalls and indicates a maximum height of the items. The controller may determine the size of the square based at least in part on the optimal item arrangement, the package size, the item sizes, and/or other factors.

At block 394, the controller may cause the projector to project the first visual indicator at the first position, the second visual indicator at the second position, and the square having the size onto the container. For example, the controller may send instructions to the projector system to project the visual indicators, such as lines and a square. The projected lines and/or square may be projected in a first color and then a second color when the adjustable sidewalls are moved into the correct position and/or the items are in compliance. The first line may indicate a position for the first moveable sidewall, the second line may indicate a position for the second moveable sidewall, and the square may indicate a maximum height for items in the bottomless container. In some embodiments, the projector may be disposed above a center of the bottomless container.

Figure 4:
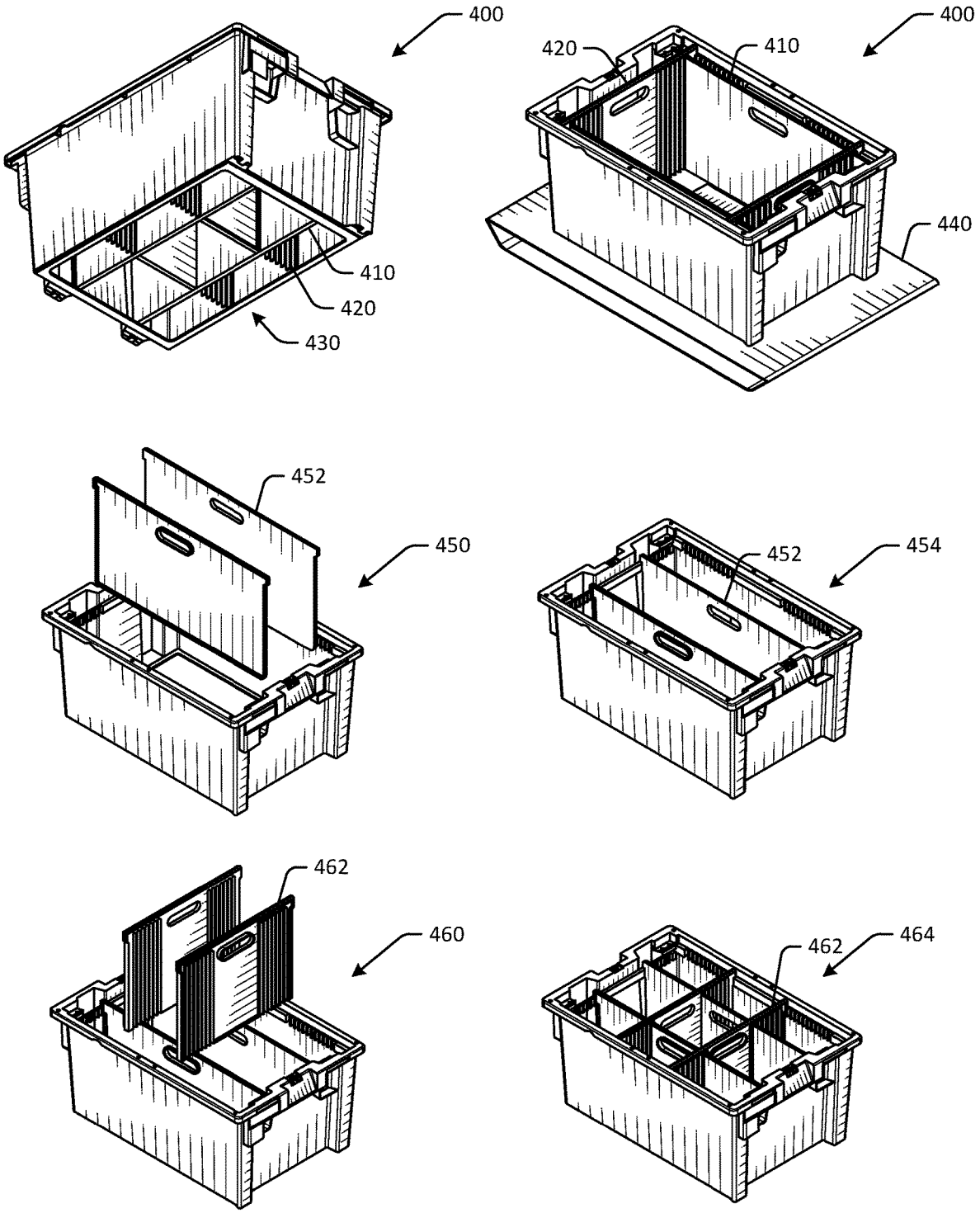
FIG. 4 is a schematic illustration of a container used to arrange multiple items for packing in accordance with one or more embodiments of the disclosure.

FIG. 4 is a schematic illustration of a container 400 used to arrange multiple items for packing in accordance with one or more embodiments of the disclosure. Other embodiments may include additional or fewer components. The illustration of FIG. 4 may not be to scale, and may not be illustrated to scale with respect to other figures. The container 400 depicted in the example of FIG. 4 is for illustrative purposes only. Other embodiments may have different configurations. The components illustrated in FIG. 4 may be the same container discussed with respect to FIGS. 1-3B.

In FIG. 4, a bottomless container 400 is depicted in various views. The bottomless container 400 may have no bottom surface 430 and may include a first adjustable sidewall 410 and a second adjustable sidewall 420, one or both of which can move with respect to the other. The bottomless container 400 may be disposed on a conveyor 440 or other surface. In some embodiments, the adjustable sidewalls may slide with respect to the edge surfaces of the bottomless container 400.

In embodiment 450, the bottomless container 400 is depicted with adjustable sidewalls 452 removed, which may be the same as adjustable sidewalls 410, and in embodiment 454, the adjustable sidewalls 452 are repositioned in a new location. In embodiment 460, adjustable sidewalls 462 are depicted as removed, and in embodiment 464, the adjustable sidewalls 462 are repositioned with the adjustable sidewalls 452 to form a location in the center in which items can be placed. When the items are placed, the bottomless container 400 can be lifted, and the items can move downstream on the conveyor 440.

Figure 5A:
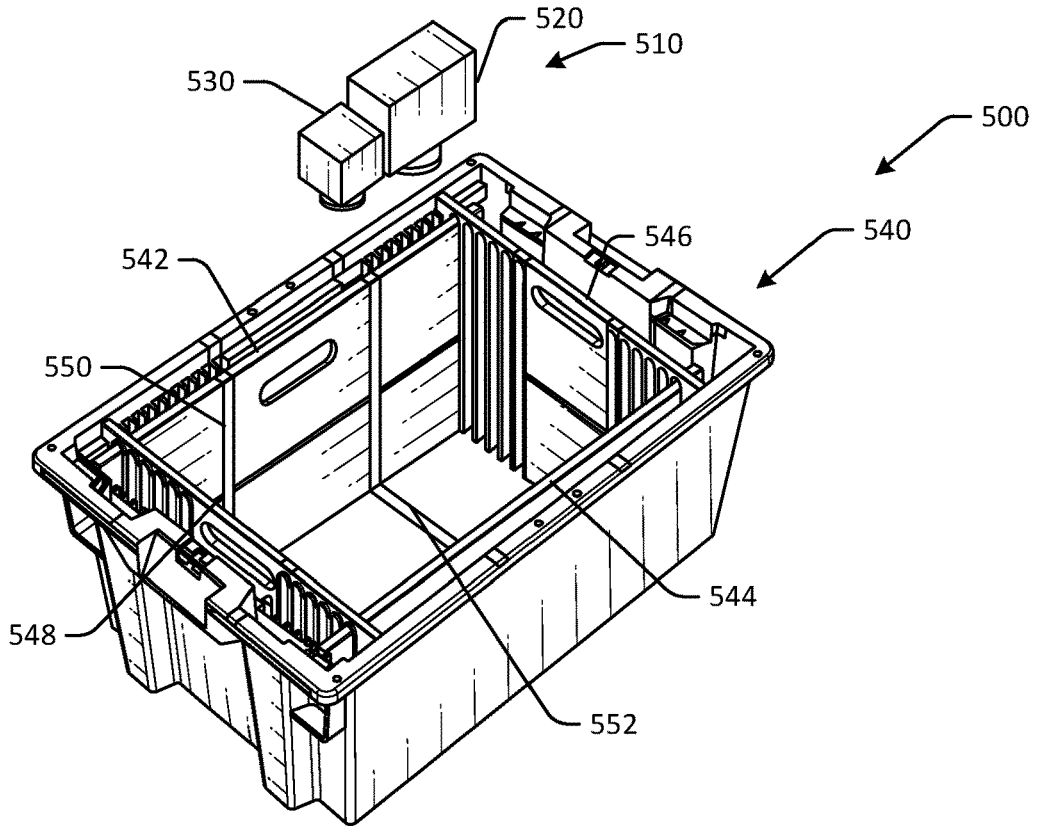
FIGS. 5A-5B are schematic illustrations of example projection of visual indicators onto a container in accordance with one or more embodiments of the disclosure.
Figure 5A:
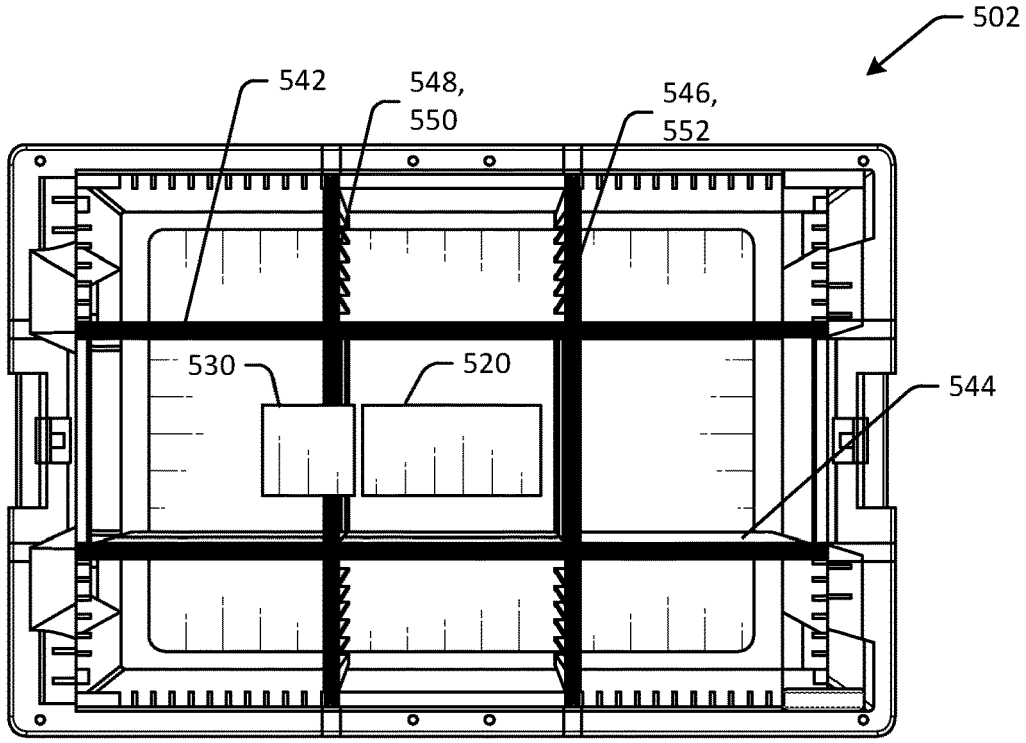
Figure 5B:
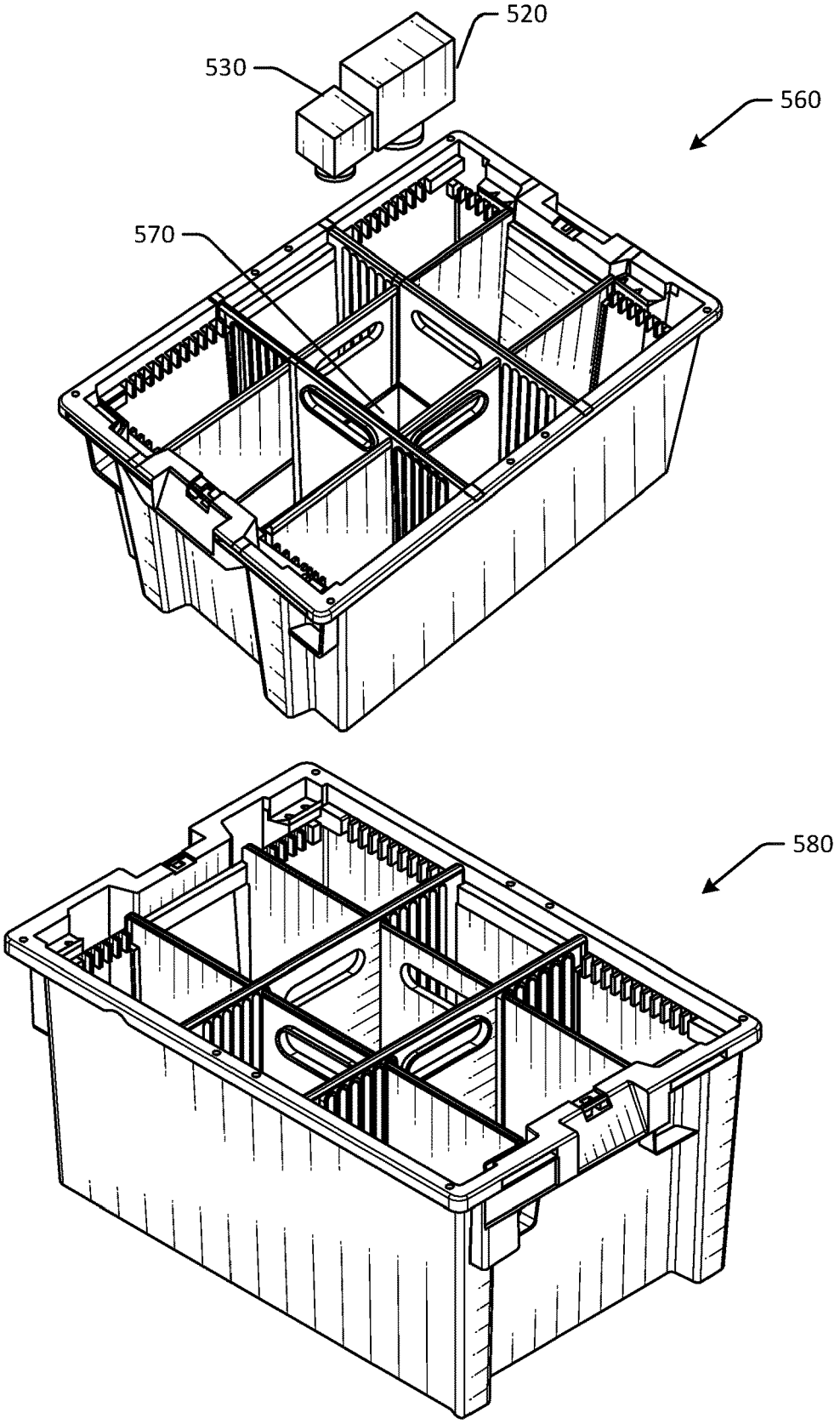

FIGS. 5A-5B are schematic illustrations of example projection of visual indicators onto a container in accordance with one or more embodiments of the disclosure. Other embodiments may include additional or fewer components. The illustrations of FIGS. 5A-5B may not be to scale, and may not be illustrated to scale with respect to other figures. The sample lines depicted in the examples of FIGS. 5A-5B are for illustrative purposes only. Other embodiments may have different lines, patterns, dimensions, or other configurations. The components illustrated in FIGS. 5A-5B may be the same as some of the components discussed with respect to FIGS. 1-4.

A system 500 may include an overhead assembly 510 that includes a projector 520 and a measurement device 530. The overhead assembly 510 may be disposed over a bottomless container 540. The bottomless container 540 may include a first adjustable sidewall 542, a second adjustable sidewall 546, a third adjustable sidewall 544, and a fourth adjustable sidewall 548. Any number of adjustable sidewalls may be included.

As depicted in top view 502, the projector 520 may project lines indicative of correct sidewall positioning, as well as a square indicative of height. A first line 550 may represent positioning for the fourth sidewall 548 and a second line 552 may represent positioning for the second sidewall 546. Other lines may represent positioning for the first sidewall 542 and the third sidewall 544.

In perspective view 560 of FIG. 5B, a square 570 projected by the projected 520 is depicted where the square represents a maximum height of items in the bottomless container 540. A final configuration 580 of the bottomless container 540 may be used to place items in the center area.

The bottomless container 540 may be a symmetric container. The bottomless container 540 may arrive and the image from the controller or edge compute device may be projected into container (sample colors may be red for length/width and yellow for height. An operator may adjust internal walls to match projected length and width. The now optimized container can be loaded with the multi-item order within the optimal length/width adjustable walls and the operator keep items below the optimal height (e.g., in the yellow area). Once competed the operator commands release of the container (e.g., optionally via a release switch) and the measurement device confirms the wall positions and height of the order passing along any feedback and/or blocking the order from progressing downstream to the robotic packing machine.

Accordingly, the controller may be configured to determine that the first moveable wall is aligned with the first line, determine that the second moveable wall is aligned with the second line, and cause presentation of a correct positioning indicator at the display, or cause the projector to present the first line and the second line in a light having a different color. The controller may cause the first item and the second item to be moved downstream. In some instances, the controller may determine that a height of the first item and the second item is equal to or less than the maximum height indicated by the square.

For errors, the controller may determine the first item and the second item are in the bottomless container, determine that a height of the first item and the second item exceed the maximum height by a first amount, determine that the first amount is less than a threshold, optionally cause the first item and the second item to be conveyed downstream for packing, and cause presentation of a correct positioning reminder notification on the display.

Figure 6:
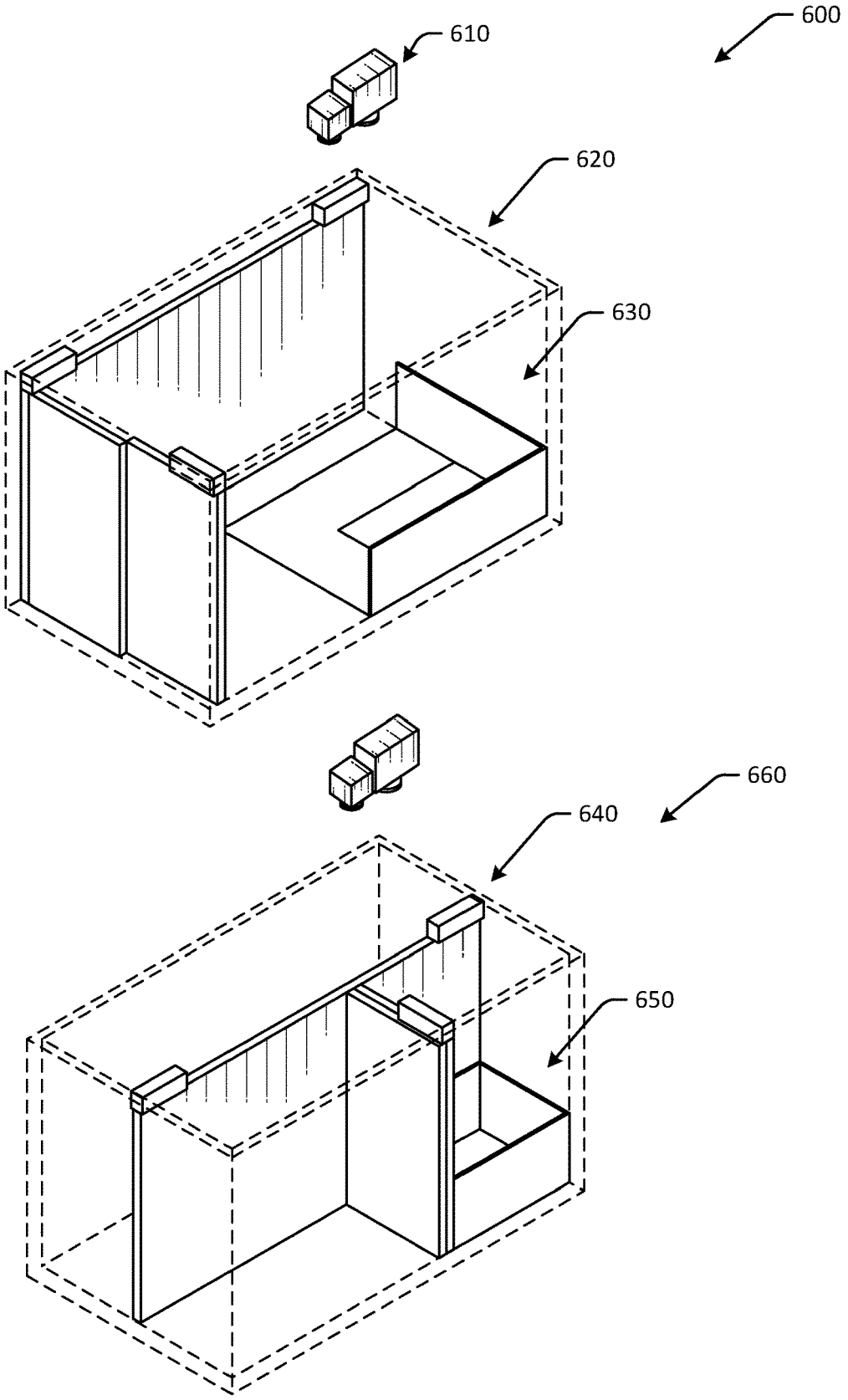
FIG. 6 is a schematic illustration of example projection of visual indicators onto a container in accordance with one or more embodiments of the disclosure.

FIG. 6 is a schematic illustration of example projection of visual indicators onto a container 620 in accordance with one or more embodiments of the disclosure. Other embodiments may include additional or fewer components. The illustration of FIG. 6 may not be to scale, and may not be illustrated to scale with respect to other figures. The sample container depicted in the examples of FIG. 6 is for illustrative purposes only. Other embodiments may have different lines, patterns, dimensions, or other configurations. The components illustrated in FIG. 6 may be the same as some of the components discussed with respect to FIGS. 1-5B.

In FIG. 6, the container 600 may be an asymmetric bottomless container. The system may include an overhead assembly 610 with a projector and measurement device, which may be positioned over a center of the container 600. The container 600 may include a first moveable wall 620 and a second moveable wall 630, where the moveable walls 620, 630 may be used in conjunction with a corner 640 of the container 600 to form an area in which items may be placed. As a result, 4 moveable walls may not be needed. The projector may be configured to keystone the square and project the square 650 onto the corner of the container 600, such that the operator is aware of the height restriction for items placed into the container 600.

Accordingly, an item packing station may include a packing system or custom-sized package generation system configured to generate a custom-sized package, a conveyor configured to transport a group of items to the packing system for packing, the group of items having a first item and a second item, a bottomless container disposed on the conveyor, the bottomless container having a first moveable sidewall and a second moveable sidewall, a projector configured to project a first line, a second line, and a square onto the bottomless container, a display, and an item measurement device; and a controller.

The controller may determine a first size of the first item using the item measurement device, determine a second size of the second item using the item measurement device, and determine a package size to be generated by the packing system based at least in part on the first size and the second size. The controller may determine an item arrangement for the first item and the second item based at least in part on the package size, where the item arrangement is an optimal arrangement of the first item and the second item inside the custom-sized package, and may determine a first position for the first line based at least in part on the item arrangement. The controller may determine a second position for the second line based at least in part on the item arrangement, and may determine a size for the square based at least in part on the item arrangement. The controller may cause the projector to project the first line onto the bottomless container at the first position, project the second line onto the bottomless container at the second position, and project the square having the size onto the bottomless container, wherein the first line indicates a position for the first moveable sidewall, the second line indicates a position for the second moveable sidewall, and the square indicates a maximum height for the items in the bottomless container.

One or more operations of the methods, process flows, or use cases of FIGS. 1-6 may have been described above as being performed by a user device, or more specifically, by one or more program module(s), applications, or the like executing on a device. It should be appreciated, however, that any of the operations of the methods, process flows, or use cases of FIGS. 1-6 may be performed, at least in part, in a distributed manner by one or more other devices, or more specifically, by one or more program module(s), applications, or the like executing on such devices. In addition, it should be appreciated that processing performed in response to the execution of computer-executable instructions provided as part of an application, program module, or the like may be interchangeably described herein as being performed by the application or the program module itself or by a device on which the application, program module, or the like is executing. While the operations of the methods, process flows, or use cases of FIGS. 1-6 may be described in the context of the illustrative devices, it should be appreciated that such operations may be implemented in connection with numerous other device configurations.

The operations described and depicted in the illustrative methods, process flows, and use cases of FIGS. 1-6 may be carried out or performed in any suitable order, such as the depicted orders, as desired in various example embodiments of the disclosure. Additionally, in certain example embodiments, at least a portion of the operations may be carried out in parallel. Furthermore, in certain example embodiments, less, more, or different operations than those depicted in FIGS. 1-6 may be performed.

Although specific embodiments of the disclosure have been described, one of ordinary skill in the art will recognize that numerous other modifications and alternative embodiments are within the scope of the disclosure. For example, any of the functionality and/or processing capabilities described with respect to a particular device or component may be performed by any other device or component. Further, while various illustrative implementations and architectures have been described in accordance with embodiments of the disclosure, one of ordinary skill in the art will appreciate that numerous other modifications to the illustrative implementations and architectures described herein are also within the scope of this disclosure.

Certain aspects of the disclosure are described above with reference to block and flow diagrams of systems, methods, apparatuses, and/or computer program products according to example embodiments. It will be understood that one or more blocks of the block diagrams and flow diagrams, and combinations of blocks in the block diagrams and the flow diagrams, respectively, may be implemented by the execution of computer-executable program instructions. Likewise, some blocks of the block diagrams and flow diagrams may not necessarily need to be performed in the order presented, or may not necessarily need to be performed at all, according to some embodiments. Further, additional components and/or operations beyond those depicted in blocks of the block and/or flow diagrams may be present in certain embodiments.

Accordingly, blocks of the block diagrams and flow diagrams support combinations of means for performing the specified functions, combinations of elements or steps for performing the specified functions, and program instruction means for performing the specified functions. It will also be understood that each block of the block diagrams and flow diagrams, and combinations of blocks in the block diagrams and flow diagrams, may be implemented by special-purpose, hardware-based computer systems that perform the specified functions, elements or steps, or combinations of special-purpose hardware and computer instructions.

Illustrative Computer Architecture

Figure 7:
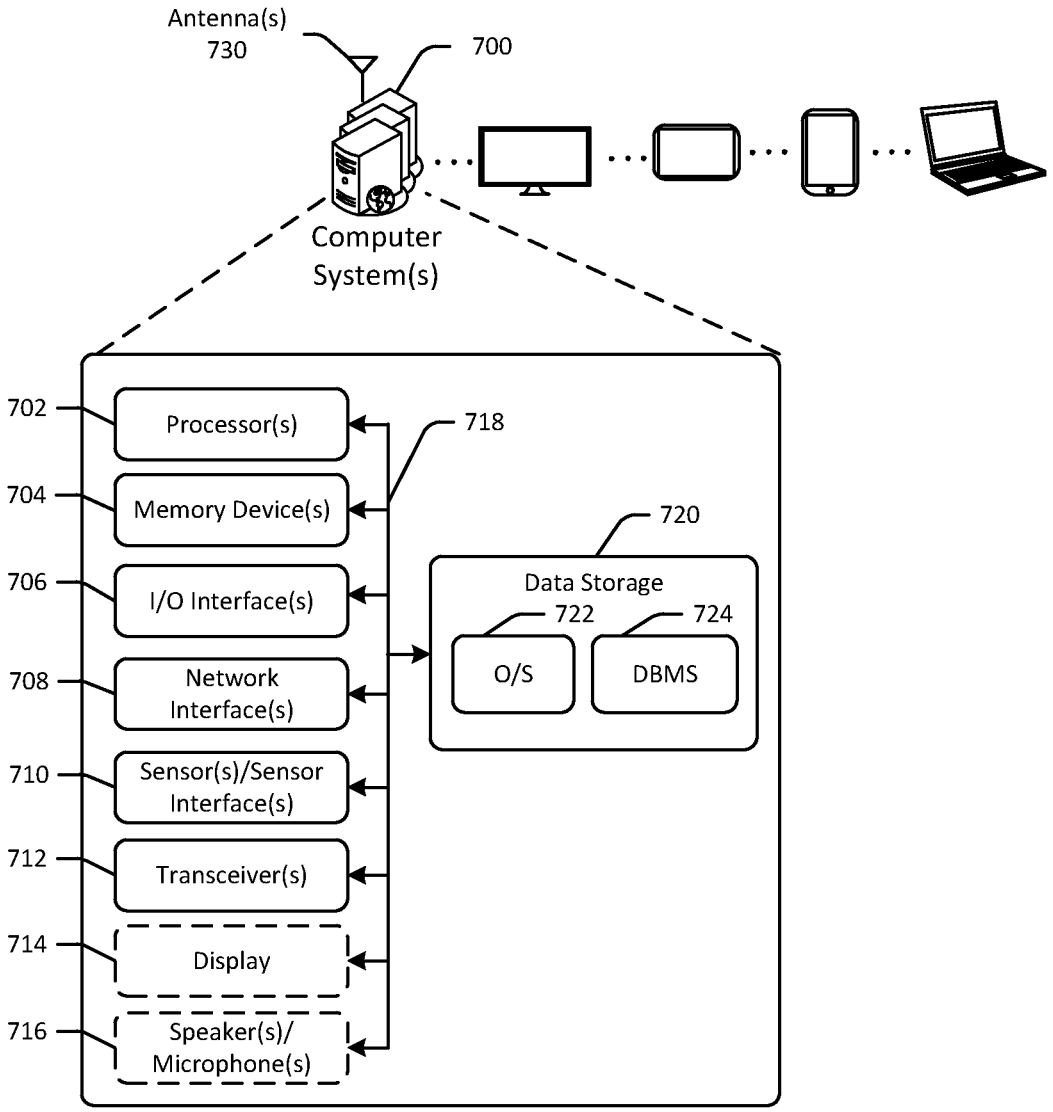
FIG. 7 schematically illustrates an example architecture of a computer system associated with a custom sized roll-formed container generation system in accordance with one or more embodiments of the disclosure.

FIG. 7 is a schematic block diagram of one or more illustrative computer system(s) 700 associated with a roll-formed container generation system in accordance with one or more example embodiments of the disclosure. The computer system(s) 700 may include any suitable computing device including, but not limited to, a server system, a voice interaction device, a mobile device such as a smartphone, a tablet, an e-reader, a wearable device, or the like; a desktop computer; a laptop computer; a content streaming device; or the like. The computer system(s) 700 may correspond to an illustrative device configuration for the controller(s) of FIGS. 1-6. For example, the computer system(s) 700 may be a controller and may control one or more aspects of the roll-formed container generation systems described in FIGS. 1-6.

The computer system(s) 700 may be configured to communicate with one or more servers, user devices, or the like. The computer system(s) 700 may be configured to control operation of one or more components of the roll-formed container generation systems, such as determining distances between creasing barrels, causing scoring wheels to move to various lateral positions, and so forth.

The computer system(s) 700 may be configured to communicate via one or more networks. Such network(s) may include, but are not limited to, any one or more different types of communications networks such as, for example, cable networks, public networks (e.g., the Internet), private networks (e.g., frame-relay networks), wireless networks, cellular networks, telephone networks (e.g., a public switched telephone network), or any other suitable private or public packet-switched or circuit-switched networks. Further, such network(s) may have any suitable communication range associated therewith and may include, for example, global networks (e.g., the Internet), metropolitan area networks (MANs), wide area networks (WANs), local area networks (LANs), or personal area networks (PANs). In addition, such network(s) may include communication links and associated networking devices (e.g., link-layer switches, routers, etc.) for transmitting network traffic over any suitable type of medium including, but not limited to, coaxial cable, twisted-pair wire (e.g., twisted-pair copper wire), optical fiber, a hybrid fiber-coaxial (HFC) medium, a microwave medium, a radio frequency communication medium, a satellite communication medium, or any combination thereof.

In an illustrative configuration, the computer system(s) 700 may include one or more processors (processor(s)) 702, one or more memory devices 704 (also referred to herein as memory 704), one or more input/output (I/O) interface(s) 706, one or more network interface(s) 708, one or more sensor(s) or sensor interface(s) 710, one or more transceiver(s) 712, one or more optional display(s) 714, one or more optional microphone(s) 716, and data storage 720. The computer system(s) 700 may further include one or more bus(es) 718 that functionally couple various components of the computer system(s) 700. The computer system(s) 700 may further include one or more antenna(s) 730 that may include, without limitation, a cellular antenna for transmitting or receiving signals to/from a cellular network infrastructure, an antenna for transmitting or receiving Wi-Fi signals to/from an access point (AP), a Global Navigation Satellite System (GNSS) antenna for receiving GNSS signals from a GNSS satellite, a Bluetooth antenna for transmitting or receiving Bluetooth signals, a Near Field Communication (NFC) antenna for transmitting or receiving NFC signals, and so forth. These various components will be described in more detail hereinafter.

The bus(es) 718 may include at least one of a system bus, a memory bus, an address bus, or a message bus, and may permit the exchange of information (e.g., data (including computer-executable code), signaling, etc.) between various components of the computer system(s) 700. The bus(es) 718 may include, without limitation, a memory bus or a memory controller, a peripheral bus, an accelerated graphics port, and so forth. The bus(es) 718 may be associated with any suitable bus architecture including, without limitation, an Industry Standard Architecture (ISA), a Micro Channel Architecture (MCA), an Enhanced ISA (EISA), a Video Electronics Standards Association (VESA) architecture, an Accelerated Graphics Port (AGP) architecture, a Peripheral Component Interconnect (PCI) architecture, a PCI-Express architecture, a Personal Computer Memory Card International Association (PCMCIA) architecture, a Universal Serial Bus (USB) architecture, and so forth.

The memory 704 of the computer system(s) 700 may include volatile memory (memory that maintains its state when supplied with power) such as random access memory (RAM) and/or non-volatile memory (memory that maintains its state even when not supplied with power) such as read-only memory (ROM), flash memory, ferroelectric RAM (FRAM), and so forth. Persistent data storage, as that term is used herein, may include non-volatile memory. In certain example embodiments, volatile memory may enable faster read/write access than non-volatile memory. However, in certain other example embodiments, certain types of non-volatile memory (e.g., FRAM) may enable faster read/write access than certain types of volatile memory.

In various implementations, the memory 704 may include multiple different types of memory such as various types of static random access memory (SRAM), various types of dynamic random access memory (DRAM), various types of unalterable ROM, and/or writeable variants of ROM such as electrically erasable programmable read-only memory (EEPROM), flash memory, and so forth. The memory 704 may include main memory as well as various forms of cache memory such as instruction cache(s), data cache(s), translation lookaside buffer(s) (TLBs), and so forth. Further, cache memory such as a data cache may be a multi-level cache organized as a hierarchy of one or more cache levels (L1, L2, etc.).

The data storage 720 may include removable storage and/or non-removable storage including, but not limited to, magnetic storage, optical disk storage, and/or tape storage. The data storage 720 may provide non-volatile storage of computer-executable instructions and other data. The memory 704 and the data storage 720, removable and/or non-removable, are examples of computer-readable storage media (CRSM) as that term is used herein.

The data storage 720 may store computer-executable code, instructions, or the like that may be loadable into the memory 704 and executable by the processor(s) 702 to cause the processor(s) 702 to perform or initiate various operations. The data storage 720 may additionally store data that may be copied to the memory 704 for use by the processor(s) 702 during the execution of the computer-executable instructions. Moreover, output data generated as a result of execution of the computer-executable instructions by the processor(s) 702 may be stored initially in the memory 704, and may ultimately be copied to the data storage 720 for non-volatile storage.

More specifically, the data storage 720 may store one or more operating systems (O/S) 722; one or more database management systems (DBMS) 724; and one or more program module(s), applications, engines, computer-executable code, scripts, or the like. Some or all of these module(s) may be sub-module(s). Any of the components depicted as being stored in the data storage 720 may include any combination of software, firmware, and/or hardware. The software and/or firmware may include computer-executable code, instructions, or the like that may be loaded into the memory 704 for execution by one or more of the processor(s) 702. Any of the components depicted as being stored in the data storage 720 may support functionality described in reference to corresponding components named earlier in this disclosure.

The data storage 720 may further store various types of data utilized by the components of the computer system(s) 700. Any data stored in the data storage 720 may be loaded into the memory 704 for use by the processor(s) 702 in executing computer-executable code. In addition, any data depicted as being stored in the data storage 720 may potentially be stored in one or more datastore(s) and may be accessed via the DBMS 724 and loaded in the memory 704 for use by the processor(s) 702 in executing computer-executable code. The datastore(s) may include, but are not limited to, databases (e.g., relational, object-oriented, etc.), file systems, flat files, distributed datastores in which data is stored on more than one node of a computer network, peer-to-peer network datastores, or the like.

The processor(s) 702 may be configured to access the memory 704 and execute the computer-executable instructions loaded therein. For example, the processor(s) 702 may be configured to execute the computer-executable instructions of the various program module(s), applications, engines, or the like of the computer system(s) 700 to cause or facilitate various operations to be performed in accordance with one or more embodiments of the disclosure. The processor(s) 702 may include any suitable processing unit capable of accepting data as input, processing the input data in accordance with stored computer-executable instructions, and generating output data. The processor(s) 702 may include any type of suitable processing unit including, but not limited to, a central processing unit, a microprocessor, a Reduced Instruction Set Computer (RISC) microprocessor, a Complex Instruction Set Computer (CISC) microprocessor, a microcontroller, an Application Specific Integrated Circuit (ASIC), a Field-Programmable Gate Array (FPGA), a System-on-a-Chip (SoC), a digital signal processor (DSP), and so forth. Further, the processor(s) 702 may have any suitable microarchitecture design that includes any number of constituent components such as, for example, registers, multiplexers, arithmetic logic units, cache controllers for controlling read/write operations to cache memory, branch predictors, or the like. The microarchitecture design of the processor(s) 702 may be capable of supporting any of a variety of instruction sets.

Referring now to other illustrative components depicted as being stored in the data storage 720, the O/S 722 may be loaded from the data storage 720 into the memory 704 and may provide an interface between other application software executing on the computer system(s) 700 and the hardware resources of the computer system(s) 700. More specifically, the O/S 722 may include a set of computer-executable instructions for managing the hardware resources of the computer system(s) 700 and for providing common services to other application programs (e.g., managing memory allocation among various application programs). In certain example embodiments, the O/S 722 may control execution of the other program module(s). The O/S 722 may include any operating system now known or which may be developed in the future including, but not limited to, any server operating system, any mainframe operating system, or any other proprietary or non-proprietary operating system.

The DBMS 724 may be loaded into the memory 704 and may support functionality for accessing, retrieving, storing, and/or manipulating data stored in the memory 704 and/or data stored in the data storage 720. The DBMS 724 may use any of a variety of database models (e.g., relational model, object model, etc.) and may support any of a variety of query languages. The DBMS 724 may access data represented in one or more data schemas and stored in any suitable data repository including, but not limited to, databases (e.g., relational, object-oriented, etc.), file systems, flat files, distributed datastores in which data is stored on more than one node of a computer network, peer-to-peer network datastores, or the like. In those example embodiments in which the computer system(s) 700 is a mobile device, the DBMS 724 may be any suitable lightweight DBMS optimized for performance on a mobile device.

Referring now to other illustrative components of the computer system(s) 700, the input/output (I/O) interface(s) 706 may facilitate the receipt of input information by the computer system(s) 700 from one or more I/O devices as well as the output of information from the computer system(s) 700 to the one or more I/O devices. The I/O devices may include any of a variety of components such as a display or display screen having a touch surface or touchscreen; an audio output device for producing sound, such as a speaker; an audio capture device, such as a microphone; an image and/or video capture device, such as a camera; a haptic unit; and so forth. Any of these components may be integrated into the computer system(s) 700 or may be separate. The I/O devices may further include, for example, any number of peripheral devices such as data storage devices, printing devices, and so forth.

The I/O interface(s) 706 may also include an interface for an external peripheral device connection such as universal serial bus (USB), Fire Wire, Thunderbolt, Ethernet port or other connection protocol that may connect to one or more networks. The I/O interface(s) 706 may also include a connection to one or more of the antenna(s) 730 to connect to one or more networks via a wireless local area network (WLAN) (such as Wi-Fi) radio, Bluetooth, ZigBec, and/or a wireless network radio, such as a radio capable of communication with a wireless communication network such as a Long Term Evolution (LTE) network, WiMAX network, 3G network, a ZigBee network, etc.

The computer system(s) 700 may further include one or more network interface(s) 708 via which the computer system(s) 700 may communicate with any of a variety of other systems, platforms, networks, devices, and so forth. The network interface(s) 708 may enable communication, for example, with one or more wireless routers, one or more host servers, one or more web servers, and the like via one or more networks.

The antenna(s) 730 may include any suitable type of antenna depending, for example, on the communications protocols used to transmit or receive signals via the antenna(s) 730. Non-limiting examples of suitable antenna(s) may include directional antenna(s), non-directional antenna(s), dipole antenna(s), folded dipole antenna(s), patch antenna(s), multiple-input multiple-output (MIMO) antenna(s), or the like. The antenna(s) 730 may be communicatively coupled to one or more transceivers 712 or radio components to which or from which signals may be transmitted or received.

As previously described, the antenna(s) 730 may include a cellular antenna configured to transmit or receive signals in accordance with established standards and protocols, such as Global System for Mobile Communications (GSM), 3G standards (e.g., Universal Mobile Telecommunications System (UMTS), Wideband Code Division Multiple Access (W-CDMA), CDMA2000, etc.), 4G standards (e.g., Long-Term Evolution (LTE), WiMax, etc.), direct satellite communications, or the like.

The antenna(s) 730 may additionally, or alternatively, include a Wi-Fi antenna configured to transmit or receive signals in accordance with established standards and protocols, such as the IEEE 802.11 family of standards, including via 2.4 GHz channels (e.g., 802.11b, 802.11g. 802.11n), 5 GHZ channels (e.g., 802.11n, 802.11ac), or 60 GHz channels (e.g., 802.11ad). In alternative example embodiments, the antenna(s) 730 may be configured to transmit or receive radio frequency signals within any suitable frequency range forming part of the unlicensed portion of the radio spectrum.

The antenna(s) 730 may additionally, or alternatively, include a GNSS antenna configured to receive GNSS signals from three or more GNSS satellites carrying time-position information to triangulate a position therefrom. Such a GNSS antenna may be configured to receive GNSS signals from any current or planned GNSS such as, for example, the Global Positioning System (GPS), the GLONASS System, the Compass Navigation System, the Galileo System, or the Indian Regional Navigational System.

The transceiver(s) 712 may include any suitable radio component(s) for—in cooperation with the antenna(s) 730—transmitting or receiving radio frequency (RF) signals in the bandwidth and/or channels corresponding to the communications protocols utilized by the computer system(s) 700 to communicate with other devices. The transceiver(s) 712 may include hardware, software, and/or firmware for modulating, transmitting, or receiving—potentially in cooperation with any of antenna(s) 730—communications signals according to any of the communications protocols discussed above including, but not limited to, one or more Wi-Fi and/or Wi-Fi direct protocols, as standardized by the IEEE 802.11 standards, one or more non-Wi-Fi protocols, or one or more cellular communications protocols or standards. The transceiver(s) 712 may further include hardware, firmware, or software for receiving GNSS signals. The transceiver(s) 712 may include any known receiver and baseband suitable for communicating via the communications protocols utilized by the computer system(s) 700. The transceiver(s) 712 may further include a low noise amplifier (LNA), additional signal amplifiers, an analog-to-digital (A/D) converter, one or more buffers, a digital baseband, or the like.

The sensor(s)/sensor interface(s) 710 may include or may be capable of interfacing with any suitable type of sensing device such as, for example, inertial sensors, force sensors, thermal sensors, photocells, and so forth. Example types of inertial sensors may include accelerometers (e.g., MEMS-based accelerometers), gyroscopes, and so forth.

The optional display(s) 714 may be configured to output light and/or render content. The optional speaker(s)/microphone(s) 716 may be any device configured to receive analog sound input or voice data.

It should be appreciated that the program module(s), applications, computer-executable instructions, code, or the like depicted in FIG. 7 as being stored in the data storage 720 are merely illustrative and not exhaustive and that processing described as being supported by any particular module may alternatively be distributed across multiple module(s) or performed by a different module. In addition, various program module(s), script(s), plug-in(s), Application Programming Interface(s) (API(s)), or any other suitable computer-executable code hosted locally on the computer system(s) 700, and/or hosted on other computing device(s) accessible via one or more networks, may be provided to support functionality provided by the program module(s), applications, or computer-executable code depicted in FIG. 7 and/or additional or alternate functionality. Further, functionality may be modularized differently such that processing described as being supported collectively by the collection of program module(s) depicted in FIG. 7 may be performed by a fewer or greater number of module(s), or functionality described as being supported by any particular module may be supported, at least in part, by another module. In addition, program module(s) that support the functionality described herein may form part of one or more applications executable across any number of systems or devices in accordance with any suitable computing model such as, for example, a client-server model, a peer-to-peer model, and so forth. In addition, any of the functionality described as being supported by any of the program module(s) depicted in FIG. 7 may be implemented, at least partially, in hardware and/or firmware across any number of devices.

It should further be appreciated that the computer system(s) 700 may include alternate and/or additional hardware, software, or firmware components beyond those described or depicted without departing from the scope of the disclosure. More particularly, it should be appreciated that software, firmware, or hardware components depicted as forming part of the computer system(s) 700 are merely illustrative and that some components may not be present or additional components may be provided in various embodiments. While various illustrative program module(s) have been depicted and described as software module(s) stored in the data storage 720, it should be appreciated that functionality described as being supported by the program module(s) may be enabled by any combination of hardware, software, and/or firmware. It should further be appreciated that each of the above-mentioned module(s) may, in various embodiments, represent a logical partitioning of supported functionality. This logical partitioning is depicted for case of explanation of the functionality and may not be representative of the structure of software, hardware, and/or firmware for implementing the functionality. Accordingly, it should be appreciated that functionality described as being provided by a particular module may, in various embodiments, be provided at least in part by one or more other module(s). Further, one or more depicted module(s) may not be present in certain embodiments, while in other embodiments, additional module(s) not depicted may be present and may support at least a portion of the described functionality and/or additional functionality. Moreover, while certain module(s) may be depicted and described as sub-module(s) of another module, in certain embodiments, such module(s) may be provided as independent module(s) or as sub-module(s) of other module(s).

Program module(s), applications, or the like disclosed herein may include one or more software components including, for example, software objects, methods, data structures, or the like. Each such software component may include computer-executable instructions that, responsive to execution, cause at least a portion of the functionality described herein (e.g., one or more operations of the illustrative methods described herein) to be performed.

A software component may be coded in any of a variety of programming languages. An illustrative programming language may be a lower-level programming language such as an assembly language associated with a particular hardware architecture and/or operating system platform. A software component comprising assembly language instructions may require conversion into executable machine code by an assembler prior to execution by the hardware architecture and/or platform.

Another example programming language may be a higher-level programming language that may be portable across multiple architectures. A software component comprising higher-level programming language instructions may require conversion to an intermediate representation by an interpreter or a compiler prior to execution.

Other examples of programming languages include, but are not limited to, a macro language, a shell or command language, a job control language, a script language, a database query or search language, or a report writing language. In one or more example embodiments, a software component comprising instructions in one of the foregoing examples of programming languages may be executed directly by an operating system or other software component without having to be first transformed into another form.

A software component may be stored as a file or other data storage construct. Software components of a similar type or functionally related may be stored together such as, for example, in a particular directory, folder, or library. Software components may be static (e.g., pre-established or fixed) or dynamic (e.g., created or modified at the time of execution).

Software components may invoke or be invoked by other software components through any of a wide variety of mechanisms. Invoked or invoking software components may comprise other custom-developed application software, operating system functionality (e.g., device drivers, data storage (e.g., file management) routines, other common routines and services, etc.), or third-party software components (e.g., middleware, encryption, or other security software, database management software, file transfer or other network communication software, mathematical or statistical software, image processing software, and format translation software).

Software components associated with a particular solution or system may reside and be executed on a single platform or may be distributed across multiple platforms. The multiple platforms may be associated with more than one hardware vendor, underlying chip technology, or operating system. Furthermore, software components associated with a particular solution or system may be initially written in one or more programming languages, but may invoke software components written in another programming language.

Computer-executable program instructions may be loaded onto a special-purpose computer or other particular machine, a processor, or other programmable data processing apparatus to produce a particular machine, such that execution of the instructions on the computer, processor, or other programmable data processing apparatus causes one or more functions or operations specified in the flow diagrams to be performed. These computer program instructions may also be stored in a computer-readable storage medium (CRSM) that upon execution may direct a computer or other programmable data processing apparatus to function in a particular manner, such that the instructions stored in the computer-readable storage medium produce an article of manufacture including instruction means that implement one or more functions or operations specified in the flow diagrams. The computer program instructions may also be loaded onto a computer or other programmable data processing apparatus to cause a series of operational elements or steps to be performed on the computer or other programmable apparatus to produce a computer-implemented process.

Additional types of CRSM that may be present in any of the devices described herein may include, but are not limited to, programmable random access memory (PRAM), SRAM, DRAM, RAM, ROM, electrically erasable programmable read-only memory (EEPROM), flash memory or other memory technology, compact disc read-only memory (CD-ROM), digital versatile disc (DVD) or other optical storage, magnetic cassettes, magnetic tape, magnetic disk storage or other magnetic storage devices, or any other medium which can be used to store the information and which can be accessed. Combinations of any of the above are also included within the scope of CRSM. Alternatively, computer-readable communication media (CRCM) may include computer-readable instructions, program module(s), or other data transmitted within a data signal, such as a carrier wave, or other transmission. However, as used herein, CRSM does not include CRCM.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

That which is claimed is:

1. An item packing station comprising:

a packing system configured to generate a custom-sized package;

a conveyor configured to transport a group of items to the packing system for packing, the group of items comprising a first item and a second item;

a bottomless container disposed on the conveyor, the bottomless container comprising a first moveable sidewall, a second moveable sidewall, a third moveable sidewall, and a fourth moveable sidewall;

a projector configured to project a first line, a second line, and a square onto the bottomless container;

a display;

an item measurement device; and a controller configured to:

determine a first size of the first item using the item measurement device;

determine a second size of the second item using the item measurement device;

determine a package size to be generated by the packing system based at least in part on the first size and the second size;

determine an item arrangement for the first item and the second item based at least in part on the package size, wherein the item arrangement is an optimal arrangement of the first item and the second item inside the custom-sized package;

determine a first position for the first line based at least in part on the item arrangement;

determine a second position for the second line based at least in part on the item arrangement;

determine a size for the square based at least in part on the item arrangement; and cause the projector to project the first line onto the bottomless container at the first position, project the second line onto the bottomless container at the second position, and project the square having the size onto the bottomless container, wherein the first line indicates a position for the first moveable sidewall, the second line indicates a position for the second moveable sidewall, and the square indicates a maximum height for the items in the bottomless container.

2. The item packing station of claim 1, wherein the controller is further configured to:

determine that the first moveable wall is aligned with the first line;

determine that the second moveable wall is aligned with the second line; and cause presentation of a correct placement notification at the display, or cause the projector to present the first line and the second line in a light having a different color.

3. The item packing station of claim 1, wherein the projector configured to project a third line and a fourth line onto the bottomless container, and wherein the controller is further configured to:

determine a third position for the third line based at least in part on the item arrangement;

determine a fourth position for the fourth line based at least in part on the item arrangement; and cause the projector to project the third line onto the bottomless container at the third position, and project the fourth line onto the bottomless container at the fourth position.

4. The item packing station of claim 1, wherein the controller is further configured to:

determine the first item and the second item are in the bottomless container;

determine that a height of the first item and the second items exceed the maximum height by a first amount;

determine that the first amount is less than a threshold;

cause the first item and the second item to be conveyed downstream for packing; and cause presentation of a correct positioning reminder notification on the display.

5. A system comprising:

a container comprising a first moveable sidewall and a second moveable sidewall;

a projector; and a controller configured to:

determine a first size of a first item to be placed in the container;

determine a second size of a second item to be placed in the container;

determine an item arrangement for the first item and the second item, wherein the item arrangement is an optimal arrangement of the first item and the second item inside a custom-sized package;

determine a first position for a first visual indicator to be projected by the projector onto the container based at least in part on the item arrangement;

determine a second position for a second visual indicator to be projected by the projector onto the container based at least in part on the item arrangement;

determine a size for a square to be projected by the projector onto the container based at least in part on the item arrangement; and cause the projector to project the first visual indicator at the first position, the second visual indicator at the second position, and the square having the size onto the container;

wherein the first visual indicator indicates a position for the first moveable sidewall, the second visual indicator indicates a position for the second moveable sidewall, and the square indicates a maximum height for items in the container.

6. The system of claim 5, wherein the controller is further configured to:

determine the first moveable sidewall is aligned with the first visual indicator;

determine the second moveable sidewall is aligned with the second visual indicator; and cause the first item and the second item to be moved downstream.

7. The system of claim 6, wherein the controller is further configured to:

determine that a height of the first item and the second item is equal to or less than the maximum height indicated by the square.

8. The system of claim 6, further comprising:

an item measurement device; and a display;

wherein the controller is further configured to:

cause presentation of a correct placement notification at the display.

9. The system of claim 6, wherein the projector is configured to emit light having a first color before the controller determines the first moveable sidewall is aligned with the first visual indicator, and to emit light having a second color after the controller determines the first moveable sidewall is aligned with the first visual indicator.

10. The system of claim 5, wherein the square is projected onto a center of the container.

11. The system of claim 5, wherein the controller is further configured to:

determine the first item and the second item are in the container;

determine that a height of the first item and the second item exceeds the maximum height by a first amount;

determine that the first amount is less than a threshold;

cause the first item and the second item to be moved downstream; and cause presentation of a correct positioning reminder notification.

12. The system of claim 5, wherein the controller is further configured to:

determine a set of available package sizes; and select a package size from the set of available package sizes to be generated by a packing system based at least in part on the first size and the second size.

13. The system of claim 5, wherein the projector is disposed above a center of the container.

14. The system of claim 13, wherein the square is projected onto a corner of the container.

15. The system of claim 5, wherein the container is a bottomless container and further comprises a third moveable sidewall and a fourth moveable sidewall.

16. A method comprising:

determining, by a controller, a first size of a first item to be placed in a container;

determining a second size of a second item to be placed in the container;

determining an item arrangement for the first item and the second item, wherein the item arrangement is an optimal arrangement of the first item and the second item inside a custom-sized package;

determining a first position for a first visual indicator to be projected by a projector onto the container based at least in part on the item arrangement;

determining a second position for a second visual indicator to be projected by the projector onto the container based at least in part on the item arrangement;

determining a size for a square to be projected by the projector onto the container based at least in part on the item arrangement; and causing the projector to project the first visual indicator at the first position, the second visual indicator at the second position, and the square having the size onto the container.

17. The method of claim 16, further comprising:

determining the first moveable sidewall is aligned with the first visual indicator;

determining the second moveable sidewall is aligned with the second visual indicator; and causing the first item and the second item to be moved downstream.

18. The method of claim 17, further comprising:

determining that a height of the first item and the second item is equal to or less than the maximum height indicated by the square.

19. The method of claim 16, further comprising:

determining the first item and the second item are in the container;

determining that a height of the first item and the second item exceeds the maximum height by a first amount;

determining that the first amount is less than a threshold;

causing the first item and the second item to be moved downstream; and causing presentation of a correct positioning reminder notification.

20. The method of claim 16, further comprising:

determining a set of available package sizes; and selecting a package size from the set of available package sizes to be generated by a packing system based at least in part on the first size and the second size.

* * * * *